US011002096B2

(12) United States Patent
Tallini

(10) Patent No.: US 11,002,096 B2
(45) Date of Patent: May 11, 2021

(54) COMBUSTIBLE PELLET FOR CREATING HEATED GAS

(71) Applicant: Otto Torpedo Company, Pleasantville, PA (US)

(72) Inventor: Richard F. Tallini, Toledo, OH (US)

(73) Assignee: Otto Torpedo Company, Pleasantville, PA (US)

( * ) Notice: Subject to any disclaimer, the term of this patent is extended or adjusted under 35 U.S.C. 154(b) by 0 days.

(21) Appl. No.: 16/171,016

(22) Filed: Oct. 25, 2018

(65) Prior Publication Data

US 2019/0063173 A1 Feb. 28, 2019

Related U.S. Application Data

(63) Continuation of application No. 15/590,667, filed on May 9, 2017, now Pat. No. 10,138,696, which is a (Continued)

(51) Int. Cl.

| | |
|---|---|
| ***E21B 29/02*** | (2006.01) |
| ***F42D 1/045*** | (2006.01) |
| ***C06D 5/06*** | (2006.01) |
| ***F42B 1/00*** | (2006.01) |
| ***F42B 3/04*** | (2006.01) |
| ***F42B 3/22*** | (2006.01) |
| ***C06B 33/02*** | (2006.01) |
| ***F42B 3/12*** | (2006.01) |
| ***C06B 45/00*** | (2006.01) |
| ***E21B 29/00*** | (2006.01) |

(Continued)

(52) U.S. Cl.

CPC ..... *E21B 29/02* (2013.01); *C06B 33/02* (2013.01); *C06D 5/06* (2013.01); *F42B 1/00* (2013.01); *F42B 3/04* (2013.01); *F42B 3/122* (2013.01); *F42B 3/22* (2013.01); *F42D 1/045* (2013.01); *C06B 45/00* (2013.01); *E21B 29/00* (2013.01); *E21B 43/24* (2013.01); *E21B 43/243* (2013.01)

(58) Field of Classification Search

CPC ..... E21B 29/00; E21B 29/02; E21B 43/117; F42B 3/10; F42B 3/121; F42B 3/12; F42B 3/13; F42B 39/20

USPC ..... 102/302; 149/37, 108.6, 114, 45

See application file for complete search history.

(56) References Cited

U.S. PATENT DOCUMENTS 4,364,232 A 12/1982 Sheinbaum
4,478,151 A * 10/1984 Vetter ..... F02K 9/38 102/289

(Continued)

OTHER PUBLICATIONS

Entingh, Daniel J., Geothermal Well Stimulation Experiments in the United States, Proceedings World Geothermal Congress 2000, Kyushu-Tohoku, Japan, May 28-Jun. 10, 2000, pp. 3689-3694, International Geothermal Association, 2000.

*Primary Examiner* — Joshua T Semick

(74) *Attorney, Agent, or Firm* — Jonathan M. D'Silva; MMI Intellectual Property

(57) ABSTRACT

What is presented is a combustible pellet for creating heated gas. The combustible pellet is insertable into a cutting apparatus or a high power igniter or both. The combustible pellet is compacted to be resistant to mechanical damage and is resistant to unintentional ignition. The combustible pellet is ignitable without a loose powdered form of combustible material when the combustible pellet is in the cutting apparatus or the high power igniter.

7 Claims, 12 Drawing Sheets

Related U.S. Application Data continuation of application No. 14/469,149, filed on Aug. 26, 2014, now Pat. No. 9,677,365, which is a continuation-in-part of application No. 13/955,851, filed on Jul. 31, 2013, now Pat. No. 9,677,364.

(60) Provisional application No. 61/741,960, filed on Jul. 31, 2012, provisional application No. 61/741,996, filed on Aug. 1, 2012.

(51) Int. Cl.
*E21B 43/24* (2006.01)
*E21B 43/243* (2006.01)

(56) References Cited

U.S. PATENT DOCUMENTS 4,788,913 A * 12/1988 Stroud ..... F42B 3/11 102/202.5
5,035,756 A * 7/1991 Covino ..... C06B 33/00 102/302
5,046,563 A * 9/1991 Engel ..... E21B 29/02 102/310
5,159,146 A * 10/1992 Carisella ..... E21B 43/1185 102/222
5,347,929 A * 9/1994 Lerche ..... E21B 43/1185 102/202.14
6,752,083 B1 * 6/2004 Lerche ..... E21B 43/1185 102/202.5
7,363,847 B2 * 4/2008 Reed ..... F42B 39/14 89/36.17
7,632,365 B1 * 12/2009 D'Arche ..... C06B 33/12 149/37
8,136,439 B2 * 3/2012 Bell ..... E21B 29/02 166/55
9,022,116 B2 * 5/2015 Bell ..... F42B 1/028 166/297
10,018,018 B2 * 7/2018 Cannon ..... E21B 41/00
10,151,569 B2 * 12/2018 Glenn ..... E21B 43/1185
2004/0060735 A1 * 4/2004 Beckman ..... E21B 43/117 175/4.6
2012/0204707 A1 * 8/2012 Park ..... F42B 33/004 86/54

* cited by examiner

COMBUSTIBLE PELLET FOR CREATING HEATED GAS

This application takes priority from U.S. non-provisional application Ser. No. 15/590,667, filed May 9, 2017 which takes priority from Ser. No. 14/469,149, now U.S. Pat. No. 9,677,365, filed Aug. 26, 2014, which in turn takes priority from U.S. non-provisional application Ser. No. 13/955,851, now U.S. Pat. No. 9,677,364, filed Jul. 31, 2013, which are all incorporated herein by reference. U.S. non-provisional application Ser. No. 13/955,851 takes priority from both U.S. provisional application No. 61/741,960 filed Jul. 31, 2012 and U.S. provisional application No. 61/741,996 filed Aug. 1, 2012, both of which are also incorporated herein by reference.

BACKGROUND

In certain types of drilling operations, such as hydraulic fracturing, conduit strings will sometimes get stuck in the borehole through which the drilling is occurring. When this problem arises, it is necessary for the drilling operator to cut the conduit string as close to where the conduit is stuck as possible in order retract and salvage as much of the conduit as possible. A variety of conduit cutters are known to perform this task. One in particular, gas forming thermite pipe cutters, ignite combustible pyrotechnic materials to create a radially directed flow of heated gas that cuts the conduit into two portions. However, such prior art systems use combustible pellets that require loose powder forms of combustible material, causing the associated cutting systems to tend to have problems that make the radial flow of heated gas unreliable, unpredictable, weak, and/or not uniform. Moreover, igniting the prior art radial conduit cutting systems is also challenging in itself, which causes the combustible pellets to not be suitable for storage and transportation without the need for additional safety precautions. What is presented is an improvement to the combustible pellets and radial conduit cutting system, which create a more uniform, predictable, precise, and stronger radial flow of heated gas.

SUMMARY

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

What is presented is a combustible pellet for creating heated gas. The combustible pellet can be inserted into a cutting apparatus or a high power igniter or both. The combustible pellet is compacted to be resistant to mechanical damage, resistant to unintentional ignition, and free from a loose powdered form of combustible material when ignited in the cutting apparatus or the high power igniter.

In certain instances, the combustible pellet is compacted to between 90 percent and 99 percent of its theoretical density. The combustible pellet may be capable of being transported separate from the cutting apparatus or the high power igniter or both. The combustible pellet may also be capable of being stored separate from the cutting apparatus or the high power igniter or both. The combustible pellet may also be made from thermite, oxidizers, carbon-based fuels, Polytetrafluoroethylene, Fluoropolymer elastomer, other polymers, or some combination thereof. The combustible pellet may comprise a circular cross-section and tubular length. The combustible pellet may comprise an axial hole.

What is also presented is a cutting apparatus. The cutting apparatus comprises an apparatus housing that is adapted to be positioned in a conduit, a combustible pellet that is insertable into the apparatus housing, and a nozzle assembly. The apparatus housing has a movable sleeve section. The combustible pellet creates a flow of heated gas when it is ignited while the cutting apparatus is in use. The flow of heated gas moves the sleeve section away from the apparatus housing so as to expose a circumferential diverter gap when the cutting apparatus is in use. The cutting apparatus is also free from a loose powdered form of combustible material when the combustible pellet is in the apparatus housing.

The nozzle assembly in the apparatus housing comprises a conical head, retainer, diverter, and a spindle. The conical head has a plurality of through holes for dispersing the flow of heated gas evenly. These through holes help increase the pressure and velocity of the flow of heated gas. The retainer abuts the diverter. The diverter helps to increase the pressure and velocity of the flow of heated gas after the flow passes through the retainer. The diverter also directs the flow of the heated gas to project radially from the circumferential diverter gap. The spindle is for providing structure to the nozzle assembly and maintaining the position of the nozzle assembly in the apparatus housing.

The cutting apparatus could additionally comprise a threaded segment and a pellet igniting device. The threaded segment is securable to the apparatus housing. The pellet igniting device is releasably securable to the threaded segment. In some instances, the pellet igniting device could be adapted to affix to the combustible pellet when the combustible pellet is inserted into the apparatus housing. In some instances, the pellet igniting device could be a cartridge heater.

The diverter could have a chamfer that is for increasing the pressure and velocity of the flow of heated gas after passing through the retainer. The circumferential diverter gap could be adapted to increase the pressure and velocity of the flow of heated gas. The central axis of the combustible pellet could have an axial hole for directing the flow of heated gas towards the nozzle assembly. The cutting apparatus could be constructed to comply with the specific characteristics of the conduit. The combustible pellet could be compacted to between 90 percent and 99 percent of its theoretical density. The retainer could have a constrictor portion for increasing the pressure and velocity of the flow of heated gas as the flow passes over the diverter. The apparatus housing could be made from alloy steel or hardened steel or both. The combustible pellet could be made of thermite, oxidizers, carbon-based fuels, Polytetrafluoroethylene, Fluoropolymer elastomer, other polymers, or some combination thereof. In some instances, the cutting apparatus comprises more than one combustible pellet inserted into the apparatus housing. In other instances, the cutting apparatus comprises a heat shield that is interposed between the combustible pellet and the nozzle assembly. In such instances, the heat shield is for directing and increasing the pressure and velocity of the flow of heated gas towards the nozzle assembly.

What is also presented is a high power igniter. The high power igniter comprises an igniter housing and high wattage heater. The igniter housing is adapted to be positioned in a conduit. The igniter housing comprises a containment sub and a nozzle sub that releasably secure to each other.

The high wattage heater is positioned in the igniter housing. The high wattage heater comprises a combustible pellet and a pellet igniting device. The combustible pellet is insertable into the igniter housing and is for creating a flow of heated gas when the combustible pellet is ignited while the high power igniter is in use. The high power igniter is also free from a loose powdered form of combustible material when the combustible pellet is in the igniter housing. The nozzle sub is for directing the flow of heated gas.

The igniter housing can be made from alloy steel or hardened steel or both. The nozzle sub can be adapted to releasably secure to a cutting apparatus, such as the one discussed above. In some instance, the nozzle sub can be constructed to comply with the specific characteristics of the cutting apparatus or the specific characteristics of the conduit. The high wattage heater could further comprise a fireproof and non-conductive heat tube.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed longitudinally around the perimeter of the heat tube.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed externally around the heat tube.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed to the heat shaft through the axial hole.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed to the inner surface of the insulation sleeve.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed to the combustible pellet.

In some instances, the pellet igniting device is a cartridge heater that is insertable into an axial hole through the central axis of the combustible pellet. In some instances, the pellet igniting device is a halogen lamp.

The combustible pellet could be compacted to between 90 percent and 99 percent of its theoretical density. The combustible pellet could be made from thermite, oxidizers, carbon-based fuels, teflon, viton, other polymers, or some combination thereof. The containment sub can secure to a cable head assembly for connecting the high power igniter to an external power source. The high power igniter could comprise a containment seal for securely positioning the combustible pellet in the igniter housing. In certain instances, the containment seal can be for preventing the pellet igniting device from contacting either the nozzle sub or the containment sub.

What is also presented is a cutting system for radially projecting a flow of heated gas. The cutting system comprises a cutting apparatus and a high power igniter.

The cutting apparatus comprises an apparatus housing that is adapted to be positioned in a conduit, a combustible pellet that is insertable into the apparatus housing, and a nozzle assembly. The apparatus housing has a movable sleeve section. The combustible pellet creates a flow of heated gas when it is ignited while the cutting apparatus is in use. The flow of heated gas moves the sleeve section away from the apparatus housing so as to expose a circumferential diverter gap when the cutting apparatus is in use. The cutting apparatus is also free from a loose powdered form of combustible material when the combustible pellet is in the apparatus housing.

The nozzle assembly in the apparatus housing comprises a conical head, retainer, diverter, and a spindle. The conical head has a plurality of through holes for dispersing the flow of heated gas evenly. These through holes help increase the pressure and velocity of the flow of heated gas. The retainer abuts the diverter. The diverter helps to increase the pressure and velocity of the flow of heated gas after the flow passes through the retainer. The diverter also directs the flow of the heated gas to project radially from the circumferential diverter gap. The spindle is for providing structure to the nozzle assembly and maintaining the position of the nozzle assembly in the apparatus housing.

The high power igniter comprises an igniter housing and high wattage heater. The igniter housing is adapted to be positioned in a conduit. The igniter housing comprises a containment sub and a nozzle sub that releasably secure to each other.

The high wattage heater is positioned in the igniter housing. The high wattage heater comprises a second combustible pellet and a pellet igniting device. The second combustible pellet is insertable into the igniter housing and is for creating a flow of heated gas when the second combustible pellet is ignited while the cutting system is in use. The high power igniter is also free from a loose powdered form of combustible material when the combustible pellet is in the igniter housing. The nozzle sub is for directing the flow of heated gas.

The diverter could have a chamfer that is for increasing the pressure and velocity of the flow of heated gas after passing through the retainer. The circumferential diverter gap could be adapted to increase the pressure and velocity of the flow of heated gas. The central axis of the combustible pellet and second combustible pellet could have an axial hole. The cutting apparatus could be constructed to comply with the specific characteristics of the conduit. The combustible pellet could be compacted to between 90 percent and 99 percent of its theoretical density. The retainer could have a constrictor portion for increasing the pressure and velocity of the flow of heated gas as the flow passes over the diverter. The apparatus housing and igniter housing could be made from alloy steel or hardened steel or both. The combustible pellet could be made of thermite, oxidizers, carbon-based fuels, Polytetrafluoroethylene, Fluoropolymer elastomer, other polymers, or some combination thereof. In some instances, the cutting apparatus comprises more than one combustible pellet inserted into the apparatus housing. In other instances, the cutting apparatus comprises a heat shield that is interposed between the combustible pellet and the nozzle assembly. The heat shield is for directing and increasing the pressure and velocity of the flow of heated gas towards the nozzle assembly.

The high wattage heater could further comprise a fireproof and non-conductive heat tube. The nozzle sub can be constructed to comply with the specific characteristics of the conduit or of the cutting apparatus.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed longitudinally around the perimeter of the heat tube.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed externally around the heat tube.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed to the heat shaft through the axial hole.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed to the inner surface of the insulation sleeve.

In some instances, the pellet igniting device is a length of resistance wire. In these instances, the high wattage heater comprises an insulation sleeve for encapsulating the combustible pellet and ensuring the flow of heated gas is directed correctly. The insulation sleeve also has an electrical contact. The high wattage heater also comprises a fireproof and non-conductive heat tube in the insulation sleeve. In these instances, the pellet igniting device is affixed to the combustible pellet.

In some instances, the pellet igniting device is a cartridge heater that is insertable into an axial hole through the central axis of the combustible pellet. In some instances, the pellet igniting device is a halogen lamp.

The combustible pellet could be compacted to between 90 percent and 99 percent of its theoretical density. The combustible pellet could be made from thermite, oxidizers, carbon-based fuels, teflon, viton, other polymers, or some combination thereof. The containment sub can secure to a cable head assembly for connecting the high power igniter to an external power source. The high power igniter could comprise a containment seal for securely positioning the combustible pellet in the igniter housing. In certain instances, the containment seal can be for preventing the pellet igniting device from contacting either the nozzle sub or the containment sub. The containment sub can be secured to a cable head assembly that is for connecting the high power igniter to an external power source.

In certain instances, the high wattage heater comprises at least two additional combustible pellets insertable into the igniter housing. These two additional combustible pellets are for creating a flow of heated gas, when the additional combustible pellets are ignited while the cutting system is in use. The additional combustible pellets can also have an axial hole through their central axis.

What is also presented is a method of safely transporting a high power igniter to a job site. The method comprising—conveying a combustible pellet to a job site, the combustible pellet compacted to be resistant to mechanical damage and the combustible pellet resistant to unintentional ignition; conveying the high power igniter to the job site separately from the combustible pellet; testing an external power source for live current; subsequently connecting the high power igniter to the external power source only when no live current is running through the external power source; and subsequently assembling the high power igniter at the job site by inserting the combustible pellet into the high power igniter without a loose powdered form of combustible material. In some instances, the method comprises using the external power source to activate the high power igniter.

The combustible pellet can be compacted to between 90 percent and 99 percent of its theoretical density. The combustible pellet can also be made from thermite, oxidizers, carbon-based fuels, Polytetrafluoroethylene, Fluoropolymer elastomer, other polymers, or some combination thereof.

What is also presented is a method of safely transporting a cutting apparatus. The method comprising—conveying a combustible pellet to a job site, the combustible pellet compacted to be resistant to mechanical damage and the combustible pellet resistant to unintentional ignition; conveying the cutting apparatus to the job site separately from the combustible pellet; and assembling the cutting apparatus at the job site by inserting at least one combustible pellet into the cutting apparatus without a loose powdered form of combustible material. In some instances, the method comprises determining the number of combustible pellets to be inserted into the cutting apparatus based on the characteristics of the cutting apparatus; and inserting at least one combustible pellet into the cutting apparatus based on the characteristics of the cutting apparatus. In other instances, the method comprises determining the number of combustible pellets to be inserted into the cutting apparatus based on the characteristics of the conduit to be cut; and inserting at least one combustible pellet into the cutting apparatus based on the characteristics of the conduit to be cut.

The combustible pellet can be compacted to between 90 percent and 99 percent of its theoretical density. The combustible pellet can be made from thermite, oxidizers, carbon-based fuels, Polytetrafluoroethylene, Fluoropolymer elastomer, other polymers, or some combination thereof.

What is also presented is a method of using a cutting apparatus for radially projecting a flow of heated gas. The method comprising—conveying a plurality of combustible pellets to a job site, each combustible pellet compacted to be resistant to mechanical damage and each combustible pellet resistant to unintentional ignition; conveying the cutting apparatus to the job site separately from the plurality of combustible pellets; determining the number of combustible pellets to be inserted into the cutting apparatus; and inserting at least one of the plurality of combustible pellets into the cutting apparatus without a loose powdered form of combustible material. In some instances, the method comprises positioning the cutting apparatus in the conduit to a location to be cut.

In other instances, the method comprises determining the number of combustible pellets to be inserted into the cutting apparatus based on the characteristics of the conduit to be cut; and inserting at least one of the plurality of combustible pellets into the cutting apparatus based on that determination of the characteristics of the conduit to be cut. In other instances, the method comprises determining the number of combustible pellets to be inserted into the cutting apparatus based on the characteristics of the cutting apparatus; and inserting at least one of the plurality of combustible pellets into the cutting apparatus based on that determination of the characteristics of the cutting apparatus. In other instances, the method comprises positioning the cutting apparatus in the conduit to a location to be cut; and activating the cutting device by sending a charge to the cutting device from an external power source. Each of the plurality of combustible pellets can be compacted to between 90 percent and 99 percent of its theoretical density. Each of the plurality of combustible pellets can be made from thermite, oxidizers, carbon-based fuels, Polytetrafluoroethylene, Fluoropolymer elastomer, and other polymers, or some combination thereof.

BRIEF DESCRIPTION OF DRAWINGS

For a more complete understanding and appreciation of this invention, and its many advantages, reference will be made to the following detailed description taken in conjunction with
the accompanying drawings.

DETAILED DESCRIPTION

Figure 1:
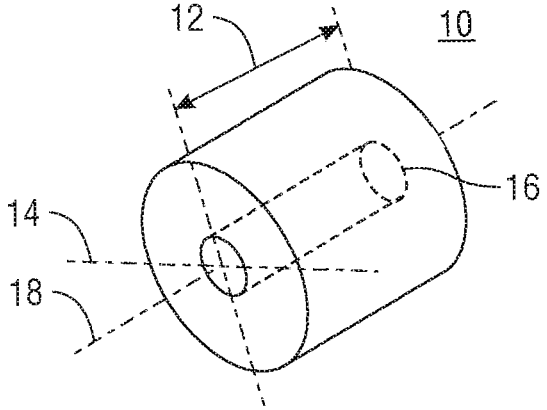
FIG. 1 shows a perspective view of a combustible pellet.
Figure 2:
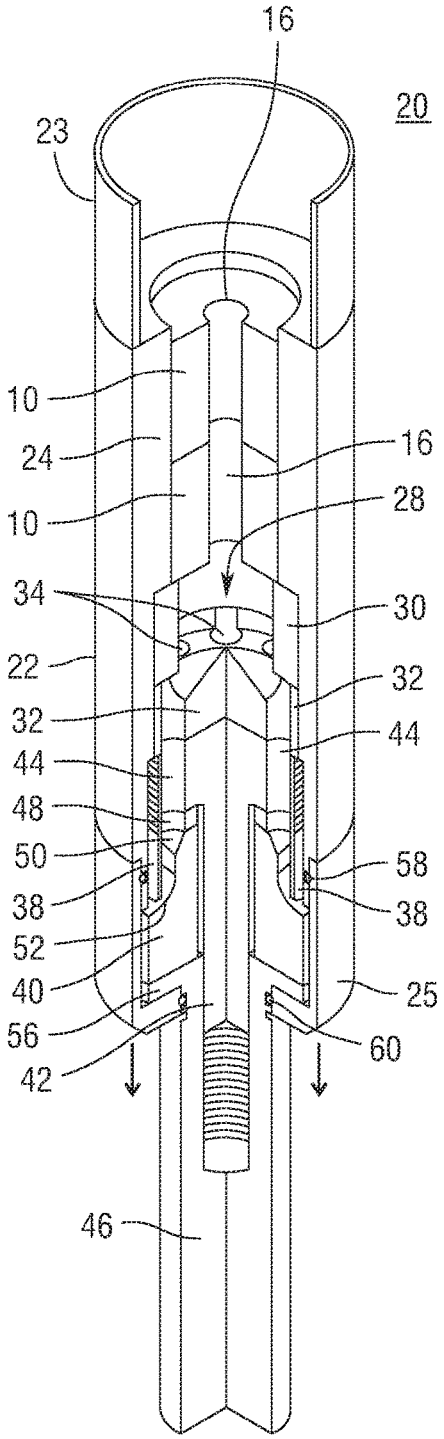
FIG. 2 shows a perspective cut-out view of a cutting apparatus for radially projecting a flow of heated gas.
Figure 3:
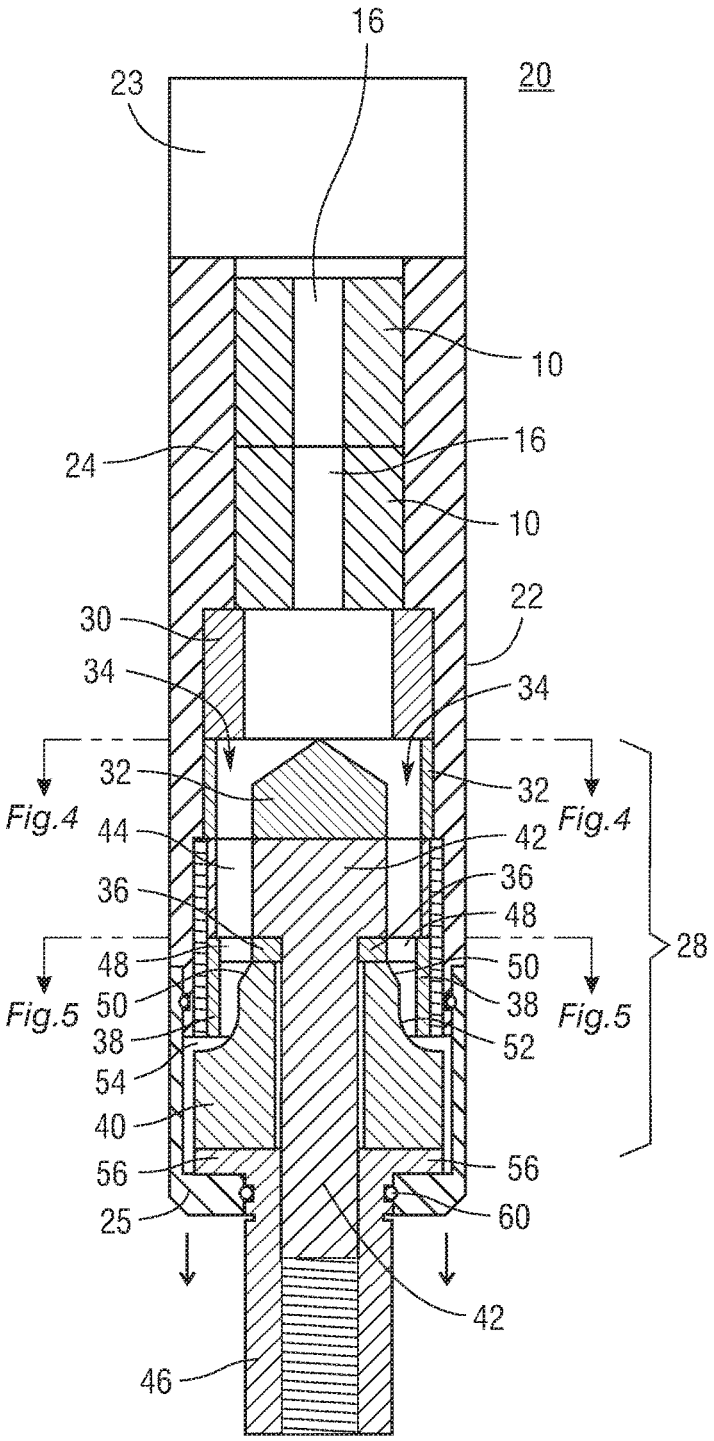
FIG. 3 shows a cross-sectional side view of the cutting apparatus of FIG. 2.
Figure 4:
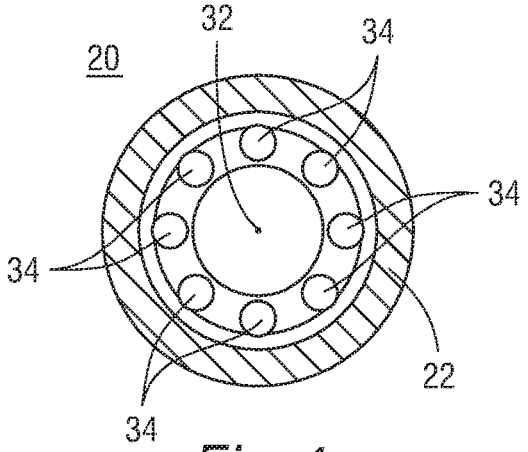
FIG. 4 shows a cross-sectional top view of the cutting apparatus of FIG. 2, as depicted by the hatch lines disclosed in FIG. 3.
Figure 5:
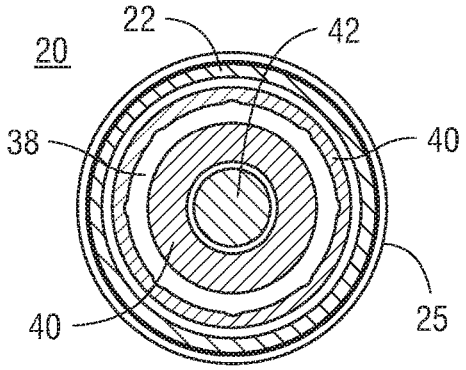
FIG. 5 shows a cross-sectional top view of the cutting apparatus of FIG. 2, as depicted by the hatch lines disclosed in FIG. 3.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

In many drilling operations for oil, gas, mining, and underwater pressure sealed tool applications, a conduit string is used to drill a well bore into the surface of the earth. The conduit string is typically a length of conduit, such as a drill pipe, extending from the earth's surface drilling the well bore as it moves through the earth.

During drilling operations, installing casing, and/or installing fluid production conduits, the conduit string may become stuck in the borehole. If the conduit string cannot be removed, then it must be cut at the location as near to where the conduit is stuck as possible. Cutting the conduit string using a cutting system discussed below, involves lowering the cutting system inside the conduit string and activating the cutting system. This causes a radially projected flow of heated gas to cut the conduit from the internal surface of the conduit through the external surface of the conduit, completely severing the conduit string into two portions. The portion above the borehole can be removed and possibly reused in another well bore. It should be understood there may be other situations that require this cutting system, which are different from the salvage operation discussed above.

Combustible pellets have been used to create flows of heated gas in the radial conduit cutting apparatus and high power igniter components of cutting systems in the past. These pellets are made so that their contents are resistant to damage and separation by being compressed under immense amounts of pressure. In many instances, it will take around 10 to 150 tons of pressure to properly compact a combustible pellet to a sufficient theoretical density. When done properly, the resulting pellets are resistant to unintentional ignition and can be stronger and slower burning than the loose powder forms of some variety of combustible material. This causes the pellets to be an adequate source for ignition for cutting systems.

However, a setback in these prior art combustible pellets is that they require the assistance of loose powdered forms of the combustible pellet to ignite when inserted in their respective prior art cutting systems. Loose powdered forms of combustible material can be very dangerous because this powder is susceptible to being accidentally initiated and, in certain instances, can be toxic. This causes certain safety regulations to maintain that these prior art cutting systems are manufactured to be preloaded and sealed with the combustible pellets and loose powdered forms of combustible material before any transportation or storage. As such, no loose powdered forms of combustible material would be able to escape into the surrounding environment and cause an unintentional contamination, explosion, and/or fire.

What has been discovered is a combustible pellet that is not only resistant to both mechanical damage and unintentional ignition, but is also able to be free from a loose powdered form of combustible material after being inserted in its cutting system and while ignited in its cutting system, discussed below. Since these combustible pellets are free from a loose powdered form of combustible material, they are also capable of being freely stored and transported separate from the components of their respective cutting system. In general, these combustible pellets are also made from combustible formulas that are non-explosive compositions including, but are not limited to, thermite, oxidizers, carbon-based fuels, Polytetrafluoroethylene (PTFE), Fluoropolymer elastomer, and other polymers, or some combination thereof (so long as that combination is able to receive a non-explosive status through the U.S. Department of Transportation).

One having ordinary skill in the art will see that the thermite composition variety of this combustible pellet can be one of thousands of compositions understood to be considered "thermite." So long as an exothermic reaction between the composition's metal oxide ingredient and a more-active pure metal ingredient occurs during ignition, otherwise known as a "Goldschmidt Reaction," the composition should be considered thermite. The pure metal ingredient and oxides may be, but are not limited to, magnesium, aluminum, and magnalium, aluminum oxide, iron (II) oxide, iron (III) oxide, copper oxide, copper (II) oxide, tin oxide, titanium oxide, manganese oxide, manganese (II) oxide, chromium oxide, cobalt oxide, silicon dioxide, nickel oxide, vanadium oxide, silver oxide, and molybdenum trioxide. One having ordinary skill in art would see that carbon-based fuel is any fuel whose energy derives principally from the oxidation or burning of carbon. One having ordinary skill in art would see that PTFE is a synthetic fluoropolymer of tetrafluoroethylene and commonly sold under the trademark name TEFLON. One having ordinary skill in art would also see that fluoropolymer elastomer is a variety of synthetic rubber and commonly sold under the trademark name VITON.

As shown in FIG. 1, the combustible pellets 10 are made to be inserted into a containment area in the apparatus housing of a cutting apparatus (shown and discussed below) and the containment sub of a high power igniter (shown and discussed below) of the cutting system. Generally, each combustible pellet 10 has a tubular length 12 and a circular cross-section 14 that is sized to fit securely into the cutting apparatus and high power igniter. However, if a certain application calls for the combustible pellet 10 to comprise a different shape, it should be understood that the combustible pellet 10 may have a length 12 that is not tubular and/or a cross-section 14 that is not circular. It should also be understood that the combustible pellet 10 could have a tubular length 12 that is elongated beyond the one disclosed, for particular applications. An axial hole 16 is burrowed through the central axis 18 of the combustible pellet 10 to increase the surface area for creating heated gas when the combustible pellet 10 has been ignited in the radial cutting apparatus and/or high power igniter.

Larger surface areas cause the combustible pellet 10 to create a stronger flow of heated gas more rapidly. The combustible pellets 10 are sized to have just enough side clearance to facilitate their loading into the cutting apparatus described herein. This has the added benefit of allowing the entire surface area of the combustible pellets 10 to be exposed to combustion. This side clearance in combination with the axial hole 16 provides two pathways for the high pressure hot gasses to flow, which allows for a faster combustion of the combustible pellets 10 than with prior art powdered forms of combustible material. In contrast, loose powdered forms of combustible materials tend to fill up gaps in the cutting apparatus, cutting off the pathways of hot gas flows, and slowing down the combustion. This results in uneven pressure buildup and reduced cutting ability compared to the combustible pellets 10 described herein.

The combustible pellet 10 is generally compressed, to be compacted between 90 percent and 99 percent of its theoretical density. Compressing the combustible pellet 10 to a theoretical density in this range allows for the combustible pellet 10 to produce a very powerful flow of heated gas in a smaller amount of space than if not compacted. Compression of this magnitude also makes the combustible pellet 10 highly resistant to mechanical damage during normal handling. If the combustible pellet 10 is dropped on a concrete floor, it is resistant to breaking or chipping.

Combustible pellets 10 compacted to a theoretical density in this range are also generally more resistant to being ignited by any local source when they have been compacted to this density, making the combustible pellet 10 safer for transportation and storage purposes, as discussed in more detail below. However, it should be understood that the benefits of compacting the combustible pellet 10 may still be seen when the pellet has been compacted to theoretical densities below 90 percent.

Compressing the combustible pellet 10 allows one having ordinary skill in the art to know the exact burning surface area of the combustible pellet 10, making it possible to determine certain propulsion characteristics of the flow of heated gas. One such characteristic is Klemmung (Kn), which is the ratio between the total burning surface area of the compressed combustible pellet 10 divided by the total exit cross-sectional surface. Kn is described by the equation:

$$Kn=A_b/A_t$$

where $A_b$ is the total burning surface area of the combustible pellets 10 and $A_t$ is the cross-sectional surface area of any exit flow path in the cutting system. Kn is directly related to the chamber pressure, which is the pressure of the flow of heated gas in the exit flow paths throughout the cutting system. One having ordinary skill in the art will see that making design changes to the combustible pellet 10, by changing its geometry, or by changing the total exit cross-sectional surface area of all the exit flow paths within the cutting system, the chamber pressure within the cutting system can be manipulated.

After being ignited, the combustible pellet 10 burns from its exposed surfaces to the interior. Since the combustible pellet 10 can be slightly regressive burning, the greatest amount of Kn, creating the greatest chamber pressure, is found at the ignition of the combustible pellet 10 and the lowest amount of Kn is found at the end of its burn. It is also understood from a design perspective, that performing calculations of the burn rate of combustible pellets 10 of known geometry is much easier than with loose powdered forms of combustible material, whose surface areas are difficult to calculate. Furthermore, these loose powders comprise large surface areas that produce Kn values in the thousands, which is explosive in nature and not propulsive in nature, and indicates that combustible pellets 10 have more controllable and predictable performance.

In the past, cutting systems of the prior art did not manipulate the cross-sectional surface area of the flow paths within the cutting system (to facilitate an increase in chamber pressure). These prior art cutting systems, in fact, decreased the chamber pressure of the flow of heated gas as it flowed throughout the cutting system by enlarging certain sections of the cross-sectional surface area of the flow paths. Decreasing the chamber pressure in this manner actually weakens the flow of heated gas before the flow is projected radially from the cutting system, making the radially-projected flow of heated gas less efficient for conduit cutting purposes. The cutting apparatus of the cutting system, discussed herein, harnesses these chamber pressure characteristics to progressively increase the pressure and velocity of the flow of heated gas while traveling through the cutting apparatus.

As shown in FIGS. 2 through 6, the cutting apparatus 20 feature of the cutting system (shown and discussed below) is manufactured to progressively and incrementally build the pressure and velocity of the flow of heated gas before being projected radially from the cutting apparatus 20. An elongated apparatus housing 22, made from alloy steel and/or hardened steel, is adapted to be positioned in a conduit 26 to be cut. The apparatus housing 22 is elongated to contain enough combustible pellets 10 within it to produce a flow of heated gas to cut through conduits 26 of varying thicknesses. The number of combustible pellets 10 is preselected depending on the characteristics of the conduit 26. The length and/or surface geometry of the combustible pellets 10 could also be manipulated based on the characteristics of the conduit 26 to be cut. The length of the apparatus housing 22 can also be varied to accommodate a different number of combustible pellets 10 as needed for the particular application, i.e. elongating the apparatus housing 22, shortening the apparatus housing 22, and/or threadably attaching extensions (not shown) to the apparatus housing. In certain instances, the cross-section of a combustible pellet 10 may be split into two equally-sized parts, lengthwise through the central axis 18, and then inserted into the apparatus housing 22. This practice would increase the surface area of the combustible pellet 22 and subsequently increase the Kn when ignited in the apparatus housing 22. Again, it should be understood that the cutting apparatus 20 is free from any loose powdered forms of combustible material when the combustible pellets are inserted into the apparatus housing 22.

The apparatus housing 22 has a heavy walled portion 24, a movable sleeve section 25, and an igniter docking section 23. The heavy walled portion 24 is configured to hold a plurality of combustible pellets 10 in their respective positions in the apparatus housing 22. As further discussed below, the igniter docking section 23 allows a high power igniter (shown and discussed below) to releasably and slidably secure (or threadably secure in certain instances) to one end of the cutting apparatus 20.

After the combustible pellets 10 are ignited, the generated flow of heated gas travels down into the apparatus housing 22 and directly through the axial hole 16 of each combustible pellet 10. The flow of heated gas also expands around the sides of the combustible pellets 10 and looks for a place to escape in those locations. The heavy walled portion 24 of the apparatus housing 22 surrounding the combustible pellet 10 does not expand outward thereby directing the entire flow of heated gas towards a nozzle assembly 28.

Prior to reaching the nozzle assembly 28, the flow of heated gas passes through a heat shield 30, which is interposed between the combustible pellets 10 and the nozzle assembly 28. The heat shield 30 has a narrower inner cross-sectional surface area than the inner cross-sectional surface area of the heavy walled portion 24 of the apparatus housing 22. This narrower cross-sectional surface area causes an increase in the Kn, progressively increasing the pressure and velocity of the flow of heated gas as it is directed towards the nozzle assembly 28.

The nozzle assembly 28 comprises a conical head 32, which includes a plurality of through holes 34, a retainer 36, which includes a constrictor portion 38, a diverter 40, a spindle 42, which includes a through hole extension portion 44, and an end cap 46. Upon reaching the nozzle assembly 28, the flow of heated gas is split apart radially and directed by the conical head 32 into each of the through holes 34. The plurality of through holes 34 distribute the flow of heated gas evenly throughout the entire nozzle assembly 28. Once in each of the through holes 34, the narrow cross-sectional surface area of each through hole 34 causes another increase in Kn, progressively increasing the pressure and velocity of the distributed flow of heated gas while passing through its respective through hole 34. After initially passing through each through hole 34, the flow of heated gas passes through the through hole extension portion 44 of the spindle 42, which is typically lined with some variety of heat resistant material. The through hole extension portion 44 has its own plurality of burrowed openings aligning with and extending the through holes 34 to the retainer 36.

After passing beyond the burrowed openings of the through hole extension portion 44, the distributed flow of heated gas reaches the retainer 36, which abuts the diverter 40. The retainer has a plurality of burrow holes 48 through it. These burrow holes 48 align with and extend the burrowed through holes 34 of the conical head 32 and the through hole extension portion 44 of the spindle 42. The burrow holes 48 on the retainer 36 also have a narrower cross-sectional surface area than the through holes 34 and the burrowed openings of the through hole extension portion 44, effectively increasing the Kn and thereby further increasing the pressure and velocity of the distributed flow of heated gas as it passes through the burrow holes 48.

After passing through the burrow holes 48, the distributed flow of heated gas is abruptly tapered into the region over the diverter 40 and under the constrictor portion 38 by a chamfer 50 on the diverter 40. The chamfer 50 further increases the Kn, abruptly increasing the pressure and velocity of the distributed flow of heated gas before it passes over the rounded surface portion 52 of the diverter 40. The chamfer 50 is a beveled edge connecting the edge of the diverter 40 abutting the retainer 36 with the rounded surface portion 52 of the diverter 40.

After passing beyond the chamfer 50, the constrictor portion 38 and the diverter 40 work in conjunction to create a channel that further increases the Kn, further increasing the pressure and velocity of the distributed flow of heated gas passing through this area. In certain embodiments, this area is where the Kn reaches its highest level within the cutting apparatus 20. The pressure and velocity of the distributed flow of heated gas is so high that it causes the distributed flow of heated gas passing out of the individual burrow holes 48 to immediately flow back together, returning to a singular flow, as if the flow wasn't distributed by the plurality of through holes 34 anywhere in the cutting apparatus 20. Bringing the flow back together in this manner increases the strength of the flow of heated gas. The flow of heated gas is then directed by the rounded surface portion 52 of the diverter 40 outward, to project radially through a circumferential diverter gap 54 formed by the space between the end tip of the constrictor portion 38 and edge of the rounded surface portion 52 of the diverter 40. The circumferential diverter gap 54 allows the flow of heated gas to cut through and sever the conduit 26 in a very concentrated and narrow area.

The circumferential diverter gap 54 can be adapted to increase the pressure and velocity of the flow of heated gas while the flow is being passed through. In these applications, the circumferential diverter gap 54 is narrowed to a distance that further increases the Kn of the flow of heated gas after passing by the rounded surface portion 52 of the diverter 40. This further increased pressure and velocity of the distributed flow of heated gas causes the radial flow of heated gas potentially to extend a farther distance and in a more concentrated and narrow area than when not adapted. Adapting the circumferential diverter gap 54 in this manner can be useful when constructing the cutting apparatus 20 to the specific characteristics of the environment in which the cutting apparatus 20 is being implemented. One having ordinary skill in the art will also see that the circumferential diverter gap 54 could also be adapted to decrease the pressure and velocity of the flow of heated gas while passing through. In these applications, the circumferential diverter gap 54 would most likely be widened.

In certain applications, certain components of the cutting apparatus 20 can be constructed to comply with the specific characteristics of the conduit 26, so as to ensure that the conduit is adequately severed. During such applications, based on the characteristics of the conduit 26, a Kn is specifically calculated to ensure the distributed flow of heated gas passed through the circumferential diverter gap 54 will be strong enough to adequately sever that specific conduit 26. At least one of the components of the cutting apparatus 20 should then be custom tailored. Custom tailoring involves effectively calibrating the inner cross-sectional surface area of the heavy walled portion 24, the inner cross-sectional surface area of the heat shield 30, the cross-sectional surface area of at least one through hole 34, and/or the cross-sectional surface area of at least one burrow hole 48 so that the pressure and velocity of the flow of heated gas is increased to this calculated Kn. The size of the chamfer 50 and/or the channel between the constrictor portion 38 and diverter 40 could also be constructed based on these calculations. It should also be understood that calibrating one of the above components can also be conducted to decrease the pressure and velocity of the flow of heated gas and shorten the flow after passing through the circumferential diverter gap 54.

If the sleeve section 25 is in the closed position when the flow of heated gas projects radially through the circumferential diverter gap 54, the flow of heated gas will force the sleeve section 25 to move downward and away from the rest of the apparatus housing 22 and into the open position. With the sleeve section 25 in the open position, the circumferential diverter gap 54 is exposed to the surrounding environment and the flow of heated gas is free to flow radially from the cutting apparatus 20 and act directly upon the conduit 26.

The spindle 42 provides structure for the nozzle assembly 28 in the apparatus housing 22 and maintains the positioning of the nozzle assembly 28. The spindle 42 allows the nozzle assembly 28 to remain stationary while the flow of heated gas passes through. The diverter 40 is positioned entirely on the spindle 42. The end cap 46 is threadably secured to the spindle 42 and holds the diverter 40 in position against the retainer 36. A shoulder portion 56 on the end cap 46 supports the diverter 40 and meets the sleeve section 25. When in the closed position, the sleeve section 25 mates smoothly with the apparatus housing 22 and keeps the cutting apparatus 20 water tight through the O-rings 58 and 60. It will be understood that the various cross-sectional surface areas that the flow of heated gas must flow through in the cutting apparatus 20 are designed to progressively increase the pressure and flow rate of the heated gas to achieve progressively higher Kn values. The final effect is that the ejected flow of heated gasses generated by the system described herein are higher in temperature and pressure than prior art systems.

Figure 7:
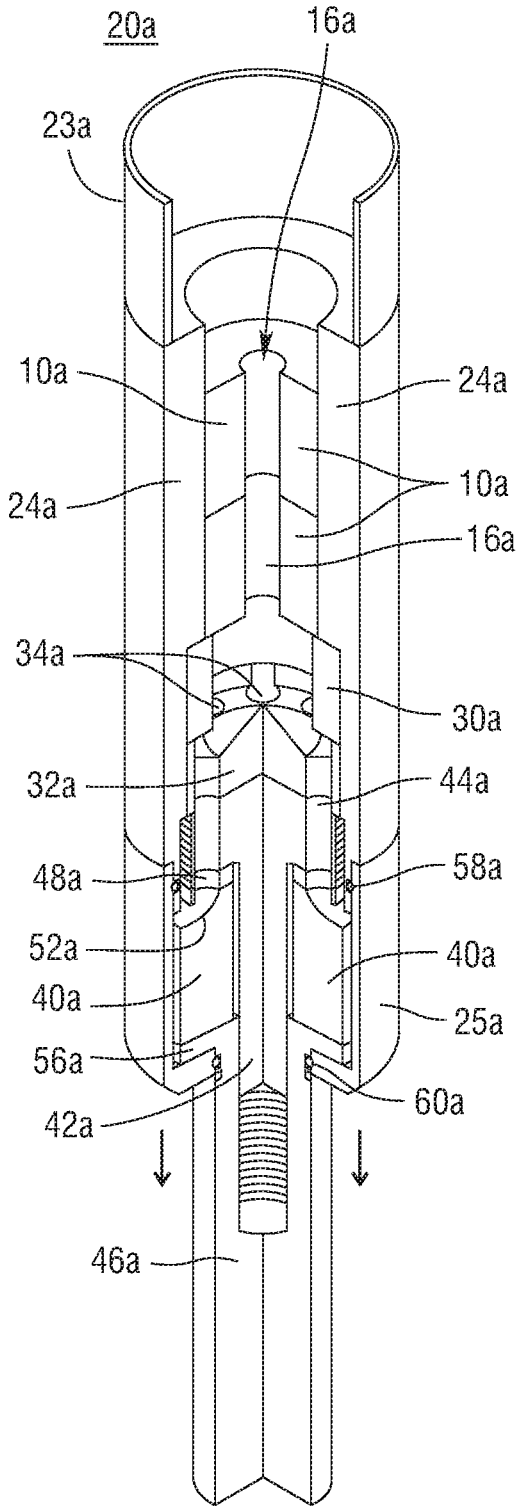
FIG. 7 shows a perspective cut-out view of another embodiment of the cutting apparatus.
Figure 8:
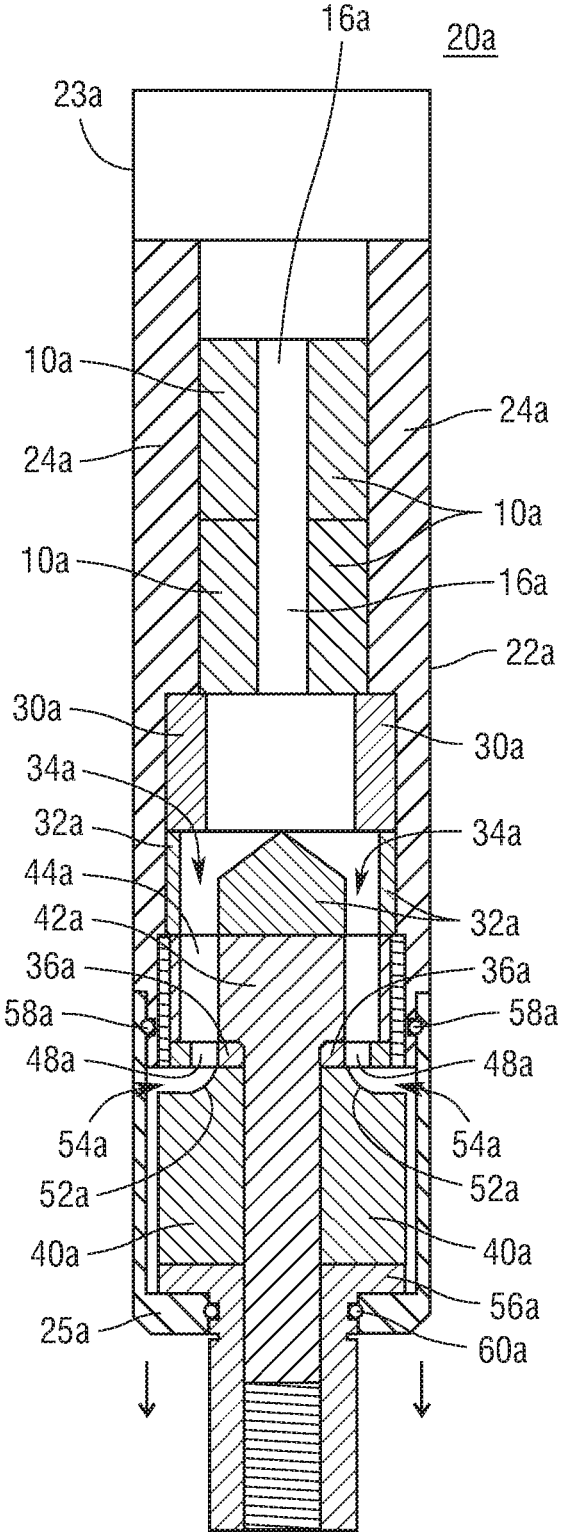
FIG. 8 shows a cross-sectional side view of the cutting apparatus of FIG. 7.
Figure 9:
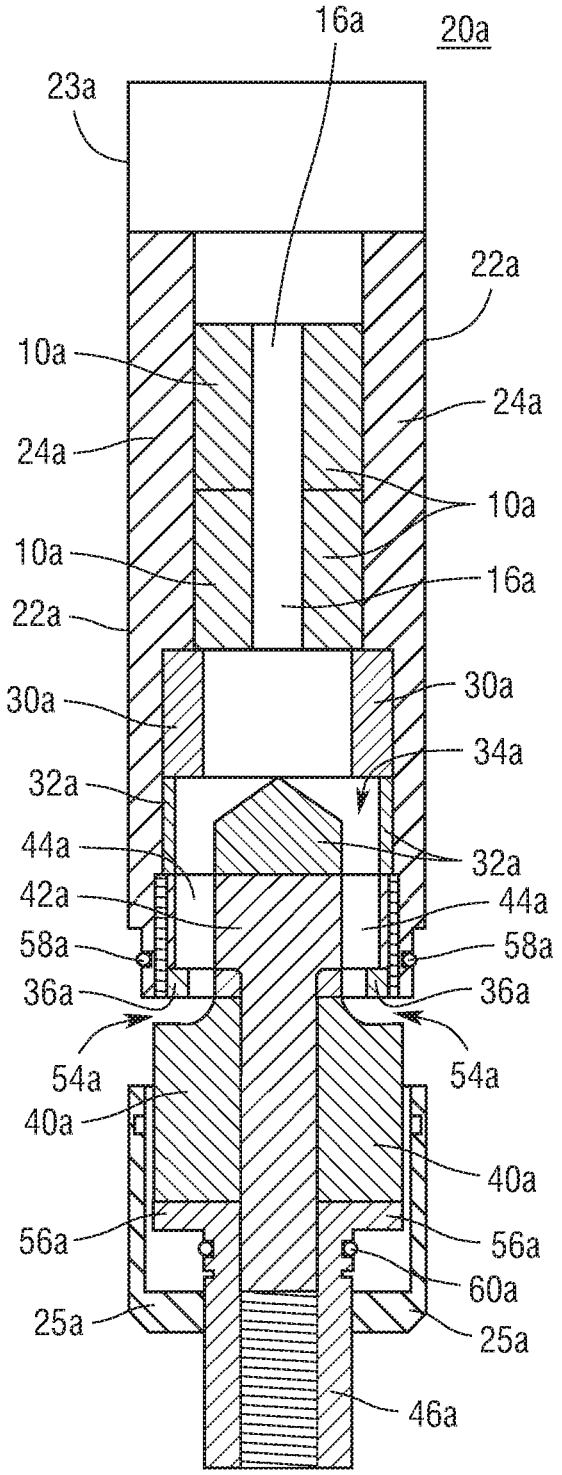
FIG. 9 shows a cross-sectional side view of the cutting apparatus of FIG. 7 with the sleeve section in the open position.

A second embodiment of the cutting apparatus **20*a* is shown in FIGS. 7 through 9. All elements of cutting apparatus 20*a* are the same as the previous embodiment, except the retainer 36*a* does not have a constrictor portion and the diverter 40*a* does not have a chamfer. In this embodiment, the burrow holes 48*a* are narrower than the burrow holes of the previous embodiment, increasing the Kn and pressure and velocity of the flow of heated gas passing through. The rounded surface portion 52*a* of the diverter 40*a* more gradually directs the flow of heated gas to project radially between the circumferential diverter gap 54*a* than the previous embodiment. The circumferential diverter gap 54*a* is also formed by the space between the retainer 36*a* and edge of the rounded surface portion 52*a* of the diverter 40*a***, instead of the space between the tip of the constructor portion and edge of the rounded surface portion of the diverter.

Figure 6:
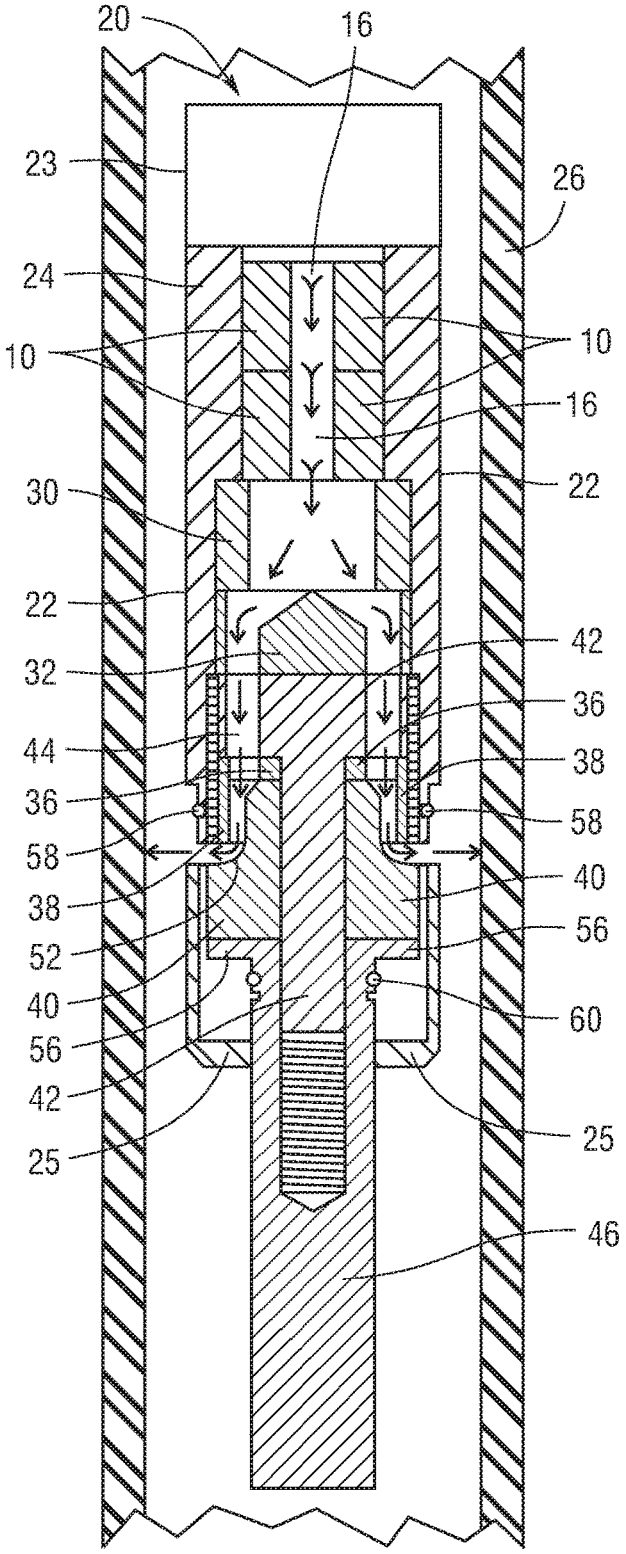
FIG. 6 shows a cross-sectional side view of the cutting apparatus of FIG. 2 in a conduit as well as the flow path of the heated gas through the cutting apparatus.

Once passing through the burrow holes **48*a*, the flow of heated gas is directed by the rounded surface portion 52*a* of the diverter 40*a* outward, projecting radially through the circumferential diverter gap 54*a*. While the flow of heated gas passes through the circumferential diverter gap 54*a*, the Kn reaches its highest level. The pressure and velocity of the distributed flow of heated gas is so high that it causes the distributed flow of heated gas passing through the circumferential diverter gap 54*a* to immediately flow back together, becoming a singular flow, as if there was no distribution by the plurality of through holes 34***a* anywhere in the cutting apparatus 20. Bringing the flow back together in this manner increases the strength of the flow of heated gas. The circumferential diverter gap 54*a* allows the flow of heated gas to cut through and sever the conduit (as shown in FIG. 6) in a very concentrated and narrow area.

The circumferential diverter gap 54*a* can be adapted to increase the pressure and velocity of the flow of heated gas while passing through. In these applications, the circumferential diverter gap 54*a* is narrowed to a distance that further increases the Kn of the flow of heated gas after passing by the rounded surface portion 52*a* of the diverter 40*a*. This further increased pressure and velocity of the distributed flow of heated gas causes the radial flow of heated gas potentially to extend a farther distance and in a more concentrated and narrow area than when not adapted. Adapting the circumferential diverter gap 54*a* in this manner can be useful when constructing the cutting apparatus 20*a* to the specific characteristics of the environment in which the cutting apparatus 20*a* is being implemented. One having ordinary skill in the art will also see that the circumferential diverter gap 54*a* can be adapted to decrease the pressure and velocity of the flow of heated gas while passing through. In these applications, the circumferential diverter gap 54*a* would most likely be widened.

As discussed above, another limitation found in the prior art cutting systems is that loose powdered forms of combustible material is required to be packed and sealed into the axial holes of their respective combustible pellets as well as potentially around the combustible pellets, so adequate ignition of the cutting apparatus can occur. The loose powder would first be ignited by some kind of igniting mechanism and would then cause these combustible pellets to ignite from the initially heated gas formed by the loose powder. Packing the axial holes with loose powder is problematic because the loose powder tends to create blockages in the axial holes that hinder the buildup of pressure and velocity of the flow of heated gas as it travels through the cutting mechanism. This causes the flow of gas to reach the nozzle assembly unevenly. Packing the axial holes with this loose powder could potentially cause safety issues and problems in transporting the cutting system to the job site when the seal is broken. As stated above, the cutting system discussed herein can be ignited free from the assistance of any loose powder form of combustible material.

Figure 10:
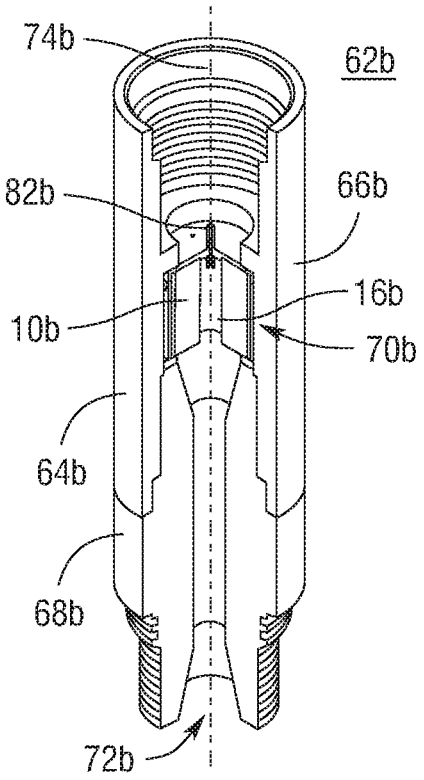
FIG. 10 shows a perspective cut-out view of an embodiment of the high power igniter that connects to the cutting apparatus.
Figure 11:
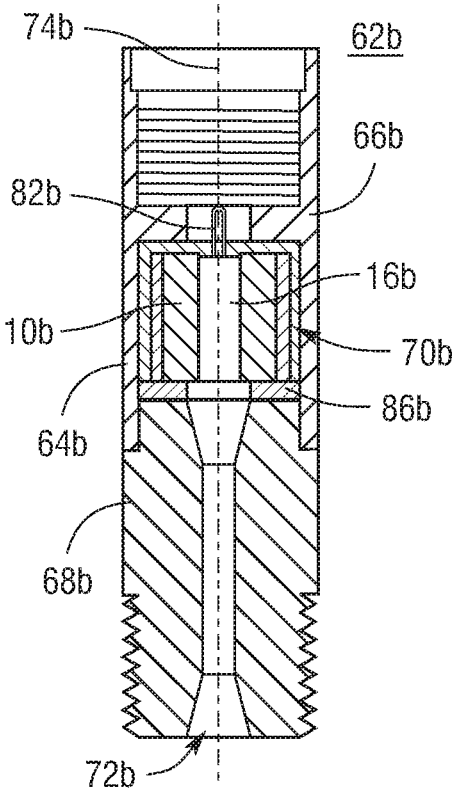
FIG. 11 shows a cross-sectional side view of the high power igniter of FIG. 10.
Figure 12:
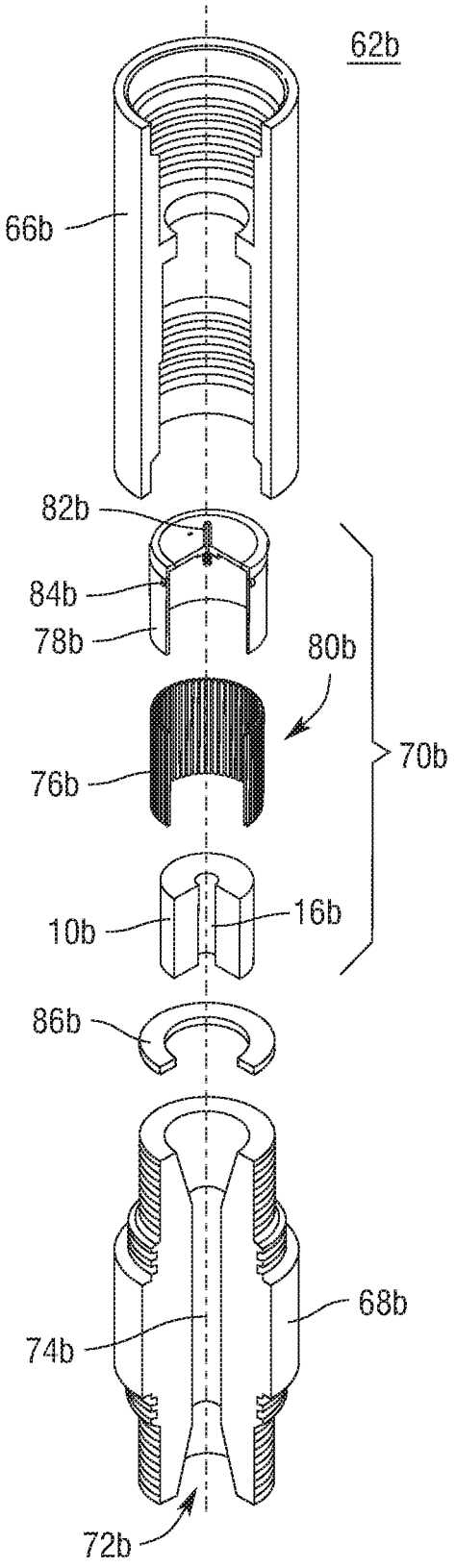
FIG. 12 shows an exploded perspective cut-out view of the high power igniter of FIG. 10.

In order to ignite the combustible pellets in the cutting assembly, some source of heat is required. FIGS. 10 through 12 show a high power igniter 62*b* that performs this function without the need for packing loose powdered forms of combustible material into the axial holes 16*b* of combustible pellets 10*b* and its associated problems. The high power igniter 62*b* releasably and slidably secures to the cutting apparatus through the igniter docking section. It should be understood, in certain embodiments, the high power igniter 62*b* can threadably secure to the cutting apparatus through the igniter docking section.

When activated, the high power igniter 62*b* ignites a combustible pellet 10*b*, which forces a high pressure flow of heated gas into the cutting apparatus (described above) to immediately and directly ignite the combustible pellets within the cutting apparatus. Upon entering the cutting apparatus, the flow of heated gas from the high power igniter 62*b* goes through the axial holes 16*b*, around the sides, and in the spaces between each combustible pellet 10*b* almost immediately, causing the total surface area of all combustible pellets 10*b* to be engulfed with the flow of heated gas.

The high power igniter 62*b* is not necessarily required to ignite the combustible pellets in the cutting assembly discussed herein. For instance, the high power igniter 62*b* may also be used to ignite other energetic material systems (not shown). One having ordinary skill in the art would understand that such energetic material systems include, but are not limited to: an igniter mechanism for solid and liquid propellants, an igniter mechanism for flammable liquids, an igniter mechanism for explosive combustible solids (such as—but not limited to—black powder, smokeless powder, composite propellant composition), and an igniter mechanism for oxidizers. The high power igniter 62*b* may also be used as an igniter for blasting guns using combustible solids as well as liquid carbon dioxide. The high power igniter 62*b* may also be used as an igniter for nitroparaffins, oxidizers, blasting agents, combustible solids in confined conditions, various bridge plug igniters, and other various high temperature blasting applications.

It should be understood that the black powder composition variety of this combustible solid is a mechanical mixture of potassium nitrate, charcoal, and sulfur. One having ordinary skill in the art will also see that black powder is the scientific name for this composition. In certain instances, black powder can be used for various types of unrelated sporting purposes as well as receive an explosive classification through a regulatory agency.

It should be understood that the smokeless powder composition variety of this combustible solid is made from colloided nitrocellulose. One having ordinary skill in the art will see that smokeless powder is the scientific name for a broad category of nitrocellulose explosives. Smokeless powder functions similarly to a high explosive or propellant explosive and, in certain instances, can receive an explosive classification through a regulatory agency. One having ordinary skill in the art will see that oxidizers are any chemical that releases large amounts of oxygen upon being ignited.

It should be understood that the composite propellant composition variety of this combustible solid is a mixture of polybutadiene acrylic acid acrylonitrile with ammonium perchlorate, aluminum, or some other ingredient. One having ordinary skill in the art will see that composite propellant is the scientific name for a broad category of propellant explosives. The high explosives composition variety of this combustible pellet is a combustible solid whose reaction rate exceeds the speed with which sound would travel through the combustible material that the combustible pellet is comprised from.

The combustible pellet 10*b* can be quickly and easily loaded into the high power igniter 62*b*. The high power igniter 62*b* ignites the flow of heated gas into the cutting apparatus through the use of a electromechanical high wattage heater 70*b*. Using an electromechanical device to ignite the combustible pellet to create a flow of heated gas, the high power igniter 62*b* adds an additional level of safety not typically seen in prior art igniters that must combine loose combustible material with an electrically heated wire in a factory assembled unit.

The high power igniter 62*b* itself comprises an igniter housing 64*b* made from alloy steel and/or hardened steel and is adapted to be positioned in the conduit (not shown), similar to the cutting apparatus discussed above. The igniter housing 64*b* itself comprises a containment sub 66*b* and a nozzle sub 68*b*. The containment sub 66*b* and nozzle sub 68*b* threadably secure to each other so as to be releasable from each other. This allows for quick and easy reloading of the high wattage heater 70*b*. The end of the nozzle sub 68*b* not securable to the containment sub 66*b* connects to the cutting apparatus.

The nozzle sub 68*b* has an orifice 72*b* through its central axis 74*b*, which is tapered on both ends. The orifice 72*b* regulates the pressure and velocity of the flow of heated gas and directs the flow of heated gas towards the cutting apparatus, after the high power igniter 62*b* has been activated. It should be understood the cross-sectional surface area of the orifice 72*b* may be changed to manipulate the Kn. A higher Kn will cause the flow of heated gas to travel farther from the orifice 72*b*, allowing there to be more space between the high power igniter 62*b* and cutting apparatus if needed. Typically, when the high power igniter 62*b* is not releasably and slidably secured to the cutting apparatus, the flow of heated gas can extend from the orifice 72*d* at a distance of over 15 feet.

In certain instances, the orifice 72*b* may be constructed to comply with the specific characteristics of the cutting apparatus. Similarly to what has been discussed above, the cross-section of the orifice 72*b* can be effectively calibrated based on a certain calculated Kn, which complies with the characteristics of the cutting apparatus. In other instances, the orifice 72*b* of the nozzle sub 68*b* could be effectively calibrated to comply with the conduit to be cut. In these instances, some kind of diverting apparatus (not shown) may be attached to the end of the nozzle sub 68*b*, or possibly somewhere on the igniter housing 64*b*, so that when the flow of heated gas passes out of the orifice 72*b* it is made to come into direct contact with the conduit. It should be noted that this is just one instance in which the orifice 72*b* of the nozzle sub 68*b* is constructed to comply with the conduit to be cut. Other situations may include other ways of causing the flow of heated gas to directly contact the conduit.

The containment sub 66*b* provides a pressure sealed housing for the high wattage heater 70*b*. The end of the containment sub 66*b* not secured to the nozzle sub 68*b* secures to a cable head assembly (not shown) and cables (not shown) to connect the high power igniter 62*b*, as well as the entire cutting system, to an external power source (not shown). The cable head assembly is secured to the high power igniter 62*b* in such a way that the cables are used to position and dangle the high power igniter 62*d* in the conduit (not shown) at the location to be cut. The external power source sends a charge to the high power igniter 62*b* through the cables that will activate the high wattage heater 70*b*.

The high wattage heater 70*b* comprises a combustible pellet 10*b*, discussed above, a pellet igniting device 76*b*, which is a length of resistance wire, an insulation sleeve 78*b*, and a heat tube 80*b*. Through empirical testing, it has been found that high-wattage resistance wire could potentially be used as pellet igniting device 76*b* if this resistance wire is wrapped around a combustible pellet 10*b*. While these same resistance wires could also ignite loose powdered forms of combustible material, they require more energy to ignite a compressed combustible pellet 10*b*. This serves as an additional safety feature over prior art igniters that are required to implement loose powdered forms of combustible material as their initial heat source. The preferred high wattage resistance wire is a 31 gauge nichrome wire. One of the benefits of the pellet igniting device 76*b* being a resistance wire is that in order for these pellet igniting devices 76*b* to ignite the combustible pellet 10*b*, a very narrow range of current is required: too much current and the pellet igniting device 76*b* burns out within a few seconds—far too short of a time to ignite the combustible pellet 10*b*; too little current and the pellet igniting device 76*b* will not heat up high enough to achieve the ignition temperature of the combustible pellet 10*b*. It should be understood that the high power igniter 62*b* is free from any loose powdered forms of combustible material, when the combustible pellets are inserted into the igniter housing 64*b*.

When the high power igniter 62*b* is constructed for use, the combustible pellet 10*b* is encapsulated in the insulation sleeve 78*b*. The insulation sleeve 78*b* has an open end that faces towards the nozzle sub 68*b*, so that when the combustible pellet 10*b* is ignited the flow of heated gas is directed correctly. On the end opposite from the one that is open, the insulation sleeve 78*b* comprises an electrical contact 82*b* and ground clip 84*b* that both work directly in conjunction with the cable head assembly secured to the containment sub 66*b*. The electrical contact 82*b* and ground clip 84*b* allow the charge from the external power source to meet with the pellet igniting device 76*b*. A containment seal 86*b* is used to secure the combustible pellet 10*b* in the igniter housing.

Interposed between the combustible pellet 10*b* and insulation sleeve 78*b* is the pellet igniting device and heat tube 80*b*. The pellet igniting device 76*b* is wrapped longitudinally around the entire perimeter of the heat tube 80*b* and is connected to both the electrical contact 82*b* and ground clip 84*b*. The pellet igniting device and heat tube 80*b* slide into the insulation sleeve 78*b* and the combustible pellet 10*b* slides into the pellet igniting device and heat tube 80*b*. The heat tube 80*b* is fireproof and non-conductive, so that it can withstand the heat generated from the flow of heated gas and will not unduly transmit electrical current when the pellet igniting device 76*b* is activated. In addition to its function above, the containment seal 86*b* also prevents the pellet igniting device 76*b* from making contact with the nozzle sub 68*b* or containment sub 66*b*.

When the external power source sends the charge to the high power igniter 62*b*, the charge goes through the cable head assembly, electrical contact 82*b*, and into the pellet igniting device 76*b*. Due to the characteristics of the resistance wire used, the pellet igniting device 76*b* heats up to a high temperature and subsequently bakes the combustible pellet 10*b*. Once baked to a certain temperature, the combustible pellet 10*b* will spontaneously ignite and create the flow of heated gas to be directed towards the cutting apparatus, as discussed above. In certain instances, when an application calls for a stronger flow of heated gas to be directed towards the cutting apparatus, the high power igniter 62*b* may be constructed to allow additional combustible pellets inserted into the high wattage heater 70*b*. It has been found that having three or more combustible pellets can be provide a flow of heated gas that wouldn't be so strong as to cause damage the cutting apparatus.

Figure 13:
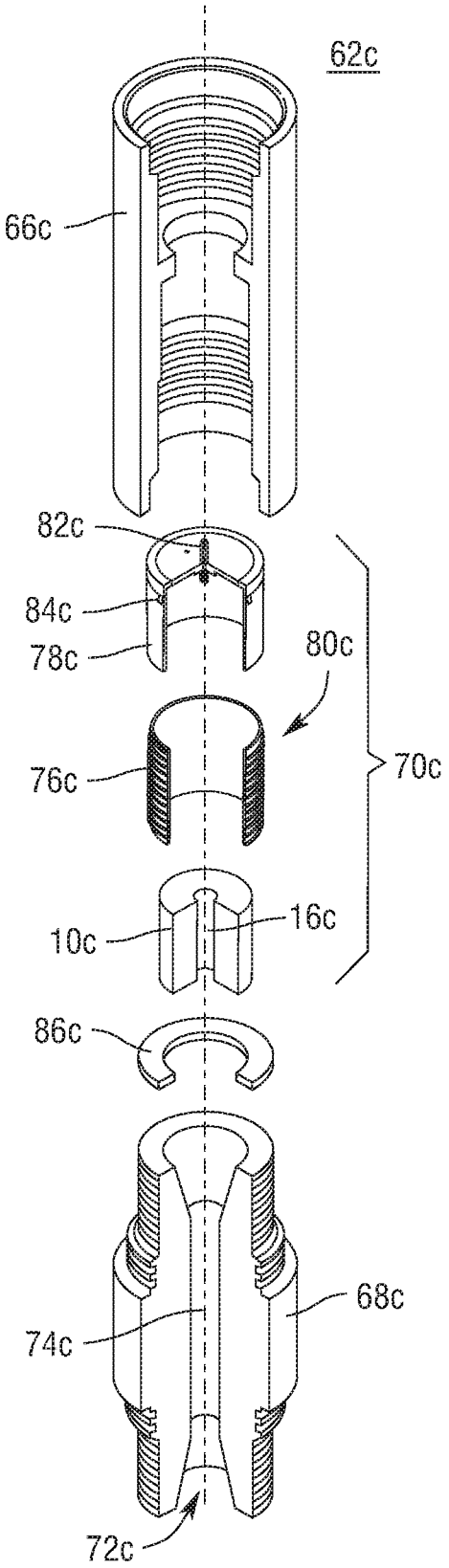
FIG. 13 shows an exploded perspective cut-out view of another embodiment of the high power igniter that connects to the cutting apparatus.

Another embodiment of the high power igniter 62*c* is shown in FIG. 13. High power igniter 62*c* comprises all the elements of the previous embodiment and in the same orientation. Except in this embodiment, the pellet igniting device 76*c* is affixed externally, lengthwise, around the outer surface of the heat tube 80*c* and is connected to both the electrical contact 82*c* and ground clip 84*c*. The pellet igniting device 76*c* is typically affixed by an enamel or fire resistant epoxy, but any means of affixing the pellet igniting device 76*c* to the heat tube 80*c* may work. The pellet igniting device and heat tube 80*c* slide into the insulation sleeve 78*c*. The combustible pellet 10*c* slides into the pellet igniting device and heat tube 80*c*.

When the external power source sends the charge to the high power igniter 62*c*, the charge goes through the cable head assembly, electrical contact 82*c*, and into the pellet igniting device 76*c*. Due to the characteristics of the resistance wire used, the pellet igniting device 76*c* heats up to a high temperature and subsequently bakes the combustible pellet 10*c*. Once baked to a certain temperature, the combustible pellet 10*c* will spontaneously ignite and create the flow of heated gas to be directed towards the cutting apparatus via the nozzle sub 68*c*, having the orifice 72*c* through its central axis 74*c*, as discussed above. In certain instances, when an application calls for a stronger flow of heated gas to be directed towards the cutting apparatus, the high power igniter 62*c* may be constructed to allow additional combustible pellets inserted into the high wattage heater 70*c*.

Figure 14:
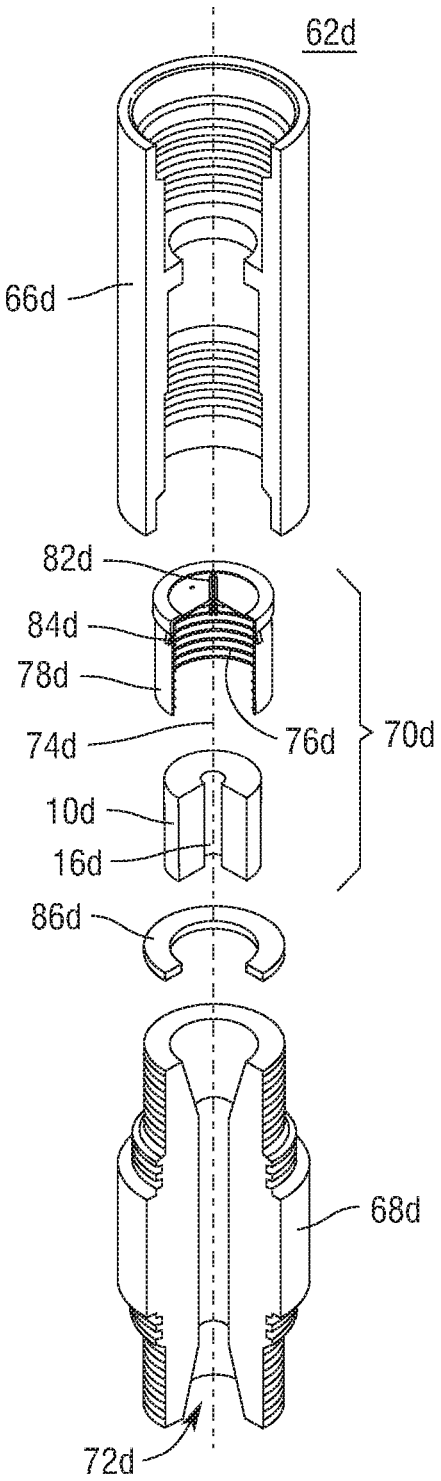
FIG. 14 shows an exploded perspective cut-out view of another embodiment of the high power igniter that connects to the cutting apparatus.

Another embodiment of the high power igniter 62*d* is shown in FIG. 14. In this embodiment, the high wattage heater 70*d* comprises a combustible pellet 10*d*, discussed above, a pellet igniting device 76*d*, which is a length of resistance wire, and an insulation sleeve 78*d*. When the high power igniter 62*d* is constructed for use, the combustible pellet 10*d* is encapsulated in the insulation sleeve 78*d*. The insulation sleeve 78*d* has an open end that faces towards the nozzle sub 68*d*. On the end opposite from the one that is open, the insulation sleeve 78*d* comprises an electrical contact 82*d* and ground clip 84*d* that both work directly in conjunction with the cable head assembly secured to the containment sub 66*d*. The electrical contact 82*d* and ground clip 84*d* allow the charge from the external power source to meet with the pellet igniting device 76*d*. A containment seal 86*d* is used to secure the combustible pellet 10*d* in the igniter housing.

Affixed lengthwise to the inner surface of the insulation sleeve 78*d* is the pellet igniting device. The pellet igniting device 76*d* is connected to both the electrical contact 82*d* and ground clip 84*d*. The pellet igniting device 76*d* is typically affixed by an enamel or fire resistant epoxy, but any means of affixing the pellet igniting device 76*d* to the inner surface of the insulation sleeve 78*d* may work. The combustible pellet 10*d* slides directly into the insulation sleeve 78*d* and pellet igniting device 76*d*.

When the external power source sends the charge to the high power igniter 62*d*, the charge goes through the cable head assembly, electrical contact 82*d*, and into the pellet igniting device 76*d*. Due to the characteristics of the resistance wire used, the pellet igniting device 76*d* heats up to a high temperature and subsequently bakes the combustible pellet 10*d*. Once baked to a certain temperature, the combustible pellet 10*d* will spontaneously ignite and create the flow of heated gas to be directed towards the cutting apparatus via the nozzle sub 68*d*, having the orifice 72*d* through its central axis 74*d*, as discussed above. In certain instances, when an application calls for a stronger flow of heated gas to be directed towards the cutting apparatus, the high power igniter 62*d* may be constructed to allow additional combustible pellets inserted into the high wattage heater 70*d*.

Figure 15:
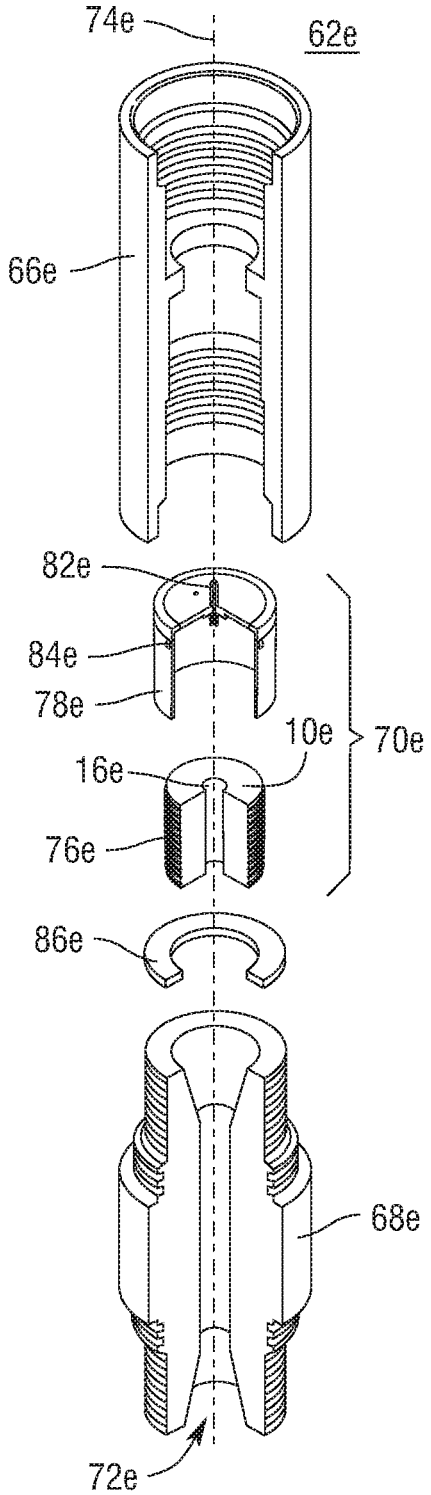
FIG. 15 shows an exploded perspective cut-out view of another embodiment of the high power igniter that connects to the cutting apparatus.

Another embodiment of the high power igniter 62*e* is shown in FIG. 15. In this embodiment, the high wattage heater 70*e* comprises a combustible pellet 10*e*, discussed above, a pellet igniting device 76*e*, which is a length of resistance wire, and an insulation sleeve 78*e*. When the high power igniter 62*e* is constructed for use, the combustible pellet 10*e* with the pellet igniting device 76*e* affixed directly on its outer surface is encapsulated in the insulation sleeve 78*e*. The pellet igniting device 76*e* is typically affixed by an enamel or fire-resistant epoxy, but any means of affixing the pellet igniting device 76*e* to the outer surface of the combustible pellet 10*e* may work.

The insulation sleeve 78*e* has an open end that faces towards the nozzle sub 68*e*. On the end opposite from the one that is open, the insulation sleeve 78*e* comprises an electrical contact 82*e* and ground clip 84*e* that both work in conjunction with the cable head assembly secured to the containment sub 66*e*. The pellet igniting device 76*e* is connected to both the electrical contact 82*e* and ground clip 84*e*. Both the combustible pellet 10*e* and its affixed pellet igniting device 76*e* slide directly into the insulation sleeve 78*e*. A containment seal 86*e* is used to secure the combustible pellet 10*e* in the igniter housing.

When the external power source sends the charge to the high power igniter 62*e*, the charge goes through the cable head assembly, electrical contact 82*e*, and into the pellet igniting device 76*e*. Due to the characteristics of the resistance wire used, the pellet igniting device 76*e* heats up to a high temperature and subsequently bakes the combustible pellet 10*e*. Once baked to a certain temperature, the combustible pellet 10*e* will spontaneously ignite and create the flow of heated gas to be directed towards the cutting apparatus via the nozzle sub 68*e*, having the orifice 72*e* through its central axis 74*e*, as discussed above. In certain instances, when an application calls for a stronger flow of heated gas to be directed towards the cutting apparatus, the high power igniter 62*e* may be constructed to allow additional combustible pellets inserted into the high wattage heater 70*e*.

Figure 16:
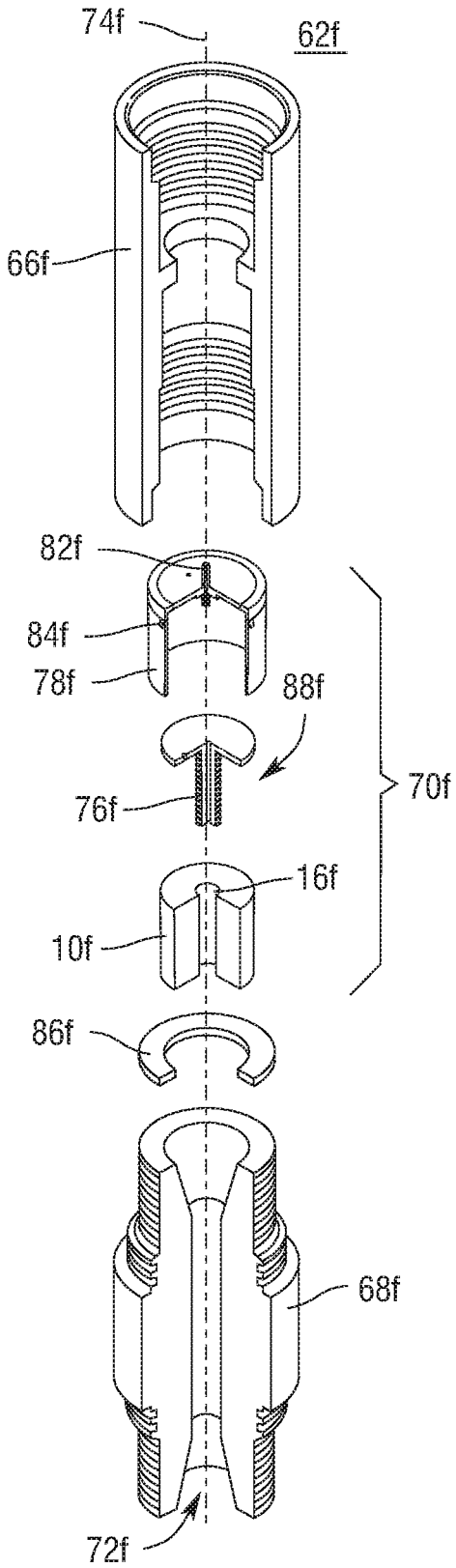
FIG. 16 shows an exploded perspective cut-out view of another embodiment of the high power igniter that connects to the cutting apparatus.

Another embodiment of the high power igniter 62*f* is shown in FIG. 16. In this embodiment, the high wattage heater 70*f* comprises a combustible pellet 10*f*, discussed above, a pellet igniting device 76*f*, which is a length of resistance wire, an insulation sleeve 78*f*, and a heat shaft 88*f*. When the high power igniter 62*f* is constructed for use, the combustible pellet 10*f* is encapsulated in the insulation sleeve 78*f*. The insulation sleeve 78*f* has an open end that faces towards the nozzle sub 68*f*, so that when the combustible pellet 10*f* is ignited the flow of heated gas is directed correctly. On the end opposite from the one that is open, the insulation sleeve 78*f* comprises an electrical contact 82*f* and ground clip 84*f* that work in conjunction with the cable head assembly secured to the containment sub 66*f*. A containment seal 86*f* is used to secure the combustible pellet 10*f* in the igniter housing.

Affixed to the combustible pellet 10*f* through its axial hole 16*f* is the pellet igniting device and heat shaft 88*f*. The pellet igniting device 76*f* is fixedly wrapped around the majority of the heat shaft 88*f* and is connected to both the electrical contact 82*f* and ground clip 84*f*. The pellet igniting device 76*f* is typically affixed by an enamel or fire resistant epoxy, but any means of fixedly wrapping the pellet igniting device 76*f* to the heat shaft 88*f* may work. The heat shaft 88*f* is fireproof and non-conductive, so that it can withstand the heat created by the pellet igniting device 76*f* and flow of heated gas and will not unduly transmit electrical current when the pellet igniting device 76*f* is activated. In addition to its function above, the containment seal 86*f* also prevents the pellet igniting device 76*f* from making contact with the nozzle sub 68*f* or containment sub 66*f*.

When the external power source sends the charge to the high power igniter 62*f*, the charge goes through the cable head assembly, electrical contact 82*f*, and into the pellet igniting device 76*f*. Due to the characteristics of the resistance wire used, the pellet igniting device 76*f* heats up to a high temperature and subsequently heats the body of the combustible pellet 10*f* surrounding it. Once it reaches a certain temperature, the combustible pellet 10*f* will spontaneously ignite and create the flow of heated gas to be directed towards the cutting apparatus via the nozzle sub 68*f*, having the orifice 72*f* through its central axis 74*f*, as discussed above. It should be understood that in this embodiment, the combustible pellet 10*f* must have the axial hole 16*f* through the central axis 74*f*, other embodiments may not need this limitation to function properly. In certain instances, when an application calls for a stronger flow of heated gas to be directed towards the cutting apparatus, the high power igniter 62*f* may be constructed to allow additional combustible pellets inserted into the high wattage heater 70*f*.

Figure 17:
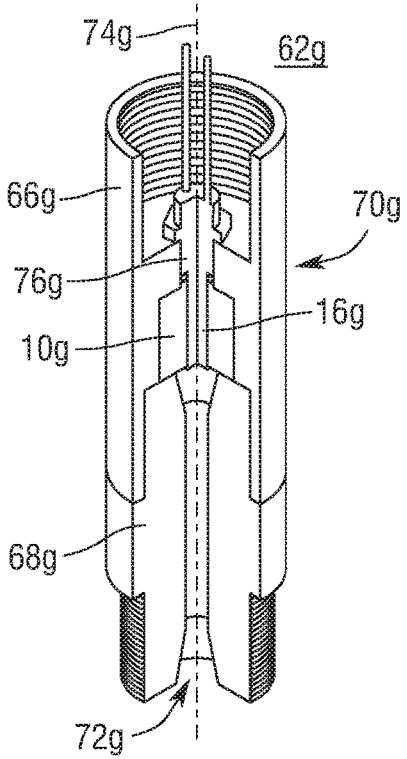
FIG. 17 shows a perspective cut-out view of another embodiment of the high power igniter that connects to the cutting apparatus.

Another embodiment of the high power igniter 62*g* is shown in FIG. 17. In this embodiment, the high wattage heater 70*g* comprises a combustible pellet 10*g*, discussed above, and a pellet igniting device 76*g*, which is a cartridge heater. This embodiment of the pellet igniting device 76*g* is different from the embodiments of resistance wire described above: it is a commercial cylindrical wire wound high wattage cartridge/insertion heaters manufactured by Watlow Corp. These pellet igniting devices 76*g* are available in shapes and sizes that enable them to fit within the axial hole 16*g* of the combustible pellet 10*g*. These pellet igniting devices 76*g* are safe for use in electromagnetic fields because of their high inductance and large power requirements. In order for these pellet igniting devices 76*g* to ignite the combustible pellet 10*g*, a very narrow range of current is required: too much current and the pellet igniting device 76*g* burns out within a few seconds—far too short of a time to effect the ignition of the combustible pellet 10*g*; too little current and the pellet igniting device 76*g* will not heat up certain to achieve the ignition temperature of the combustible pellet 10*g*. When the high power igniter 62*g* is constructed for use, the combustible pellet 10*g* is encapsulated in the containment sub 66*g*. The pellet igniting device 76*g* is threadably secured to the containment sub 66*g* and affixed to the combustible pellet 10*g* through its axial hole 16*g*.

When the external power source sends the charge to the high power igniter 62*g*, the charge goes through the cable head assembly and directly into the pellet igniting device 76*g*. Due to the characteristics of the cartridge heater, the pellet igniting device 76*g* heats up to a high temperature and subsequently heats the body of the combustible pellet 10*g* surrounding it. Once it reaches a certain temperature, the combustible pellet 10*g* will spontaneously ignite and create the flow of heated gas to be directed towards the cutting apparatus via the nozzle sub 68*g*, having the orifice

72*g* through its central axis 74*g*, as discussed above. It should be understood that in this embodiment, the combustible pellet 10*g* must have the axial hole 16*g* through the central axis 74*g*, other embodiments may not need this limitation to function properly. In certain instances, when an application calls for a stronger flow of heated gas to be directed towards the cutting apparatus, the high power igniter 62*g* may be constructed to allow additional combustible pellets inserted into the high wattage heater 70*g*.

Figure 18:
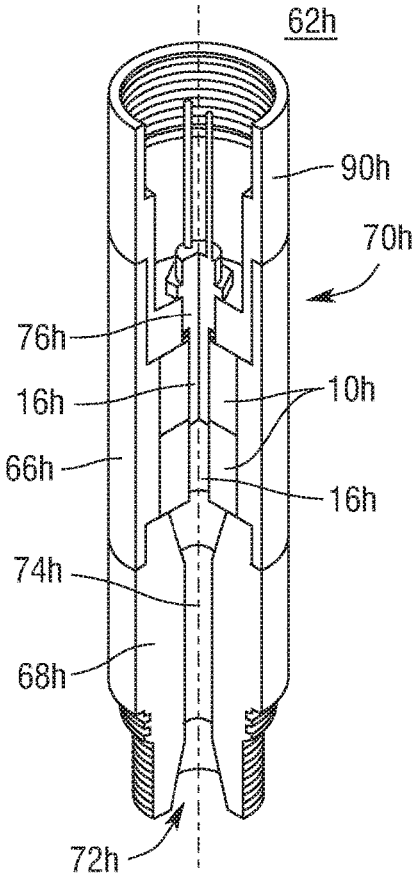
FIG. 18 shows a perspective cut-out view of another embodiment of the high power igniter that connects to the cutting apparatus.

Another embodiment of the high power igniter 62*h* is shown in FIG. 18. In this embodiment, the high wattage heater 70*h* comprises a combustible pellet 10*h*, discussed above, a threaded segment 90*h*, and a pellet igniting device 76*h*, which is a cartridge heater. When the high power igniter 62*h* is constructed for use, the combustible pellet 10*h* is encapsulated in the containment sub 66*h*. The threaded segment 90*h* is threadably secured to the containment sub 66*h*. The pellet igniting device 76*h* is threadably secured to the threaded segment 90*h* and affixed to the combustible pellet 10*h* through its axial hole 16*h*.

When the external power source sends the charge to the high power igniter 62*h*, the charge goes through the cable head assembly and into the pellet igniting device 76*h*. Due to the characteristics of the cartridge heater, the pellet igniting device 76*h* heats up to a high temperature and subsequently heats the body of the combustible pellet 10*h* surrounding it. Once it reaches a certain temperature, the combustible pellet 10*h* will spontaneously ignite and create the flow of heated gas to be directed towards the cutting apparatus via the nozzle sub 68*h*, having the orifice 72*h* through its central axis 74*h*, as discussed above. In certain instances, when an application calls for a stronger flow of heated gas to be directed towards the cutting apparatus, the high power igniter 62*h* may be constructed to allow additional combustible pellets inserted into the high wattage heater 70*h*. It should be understood that in this embodiment, the combustible pellet 10*h* must have the axial hole 16*h* through the central axis 74*h*, other embodiments may not need this limitation to function properly.

Figure 19:
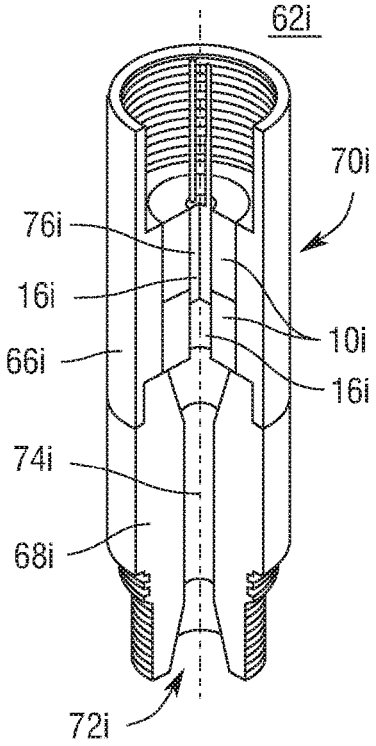
FIG. 19 shows a perspective cut-out view of another embodiment of the high power igniter that connects to the cutting apparatus.

Another embodiment of the high power igniter 62*i* is shown in FIG. 19. In this embodiment, the high wattage heater 70*i* comprises a combustible pellet 10*i*, discussed above, and a pellet igniting device 76*i*, which is a cartridge heater. When the high power igniter 62*i* is constructed for use, the combustible pellet 10*i* is positioned in the containment sub 66*i*. The pellet igniting device 76*i* is directly affixed to the combustible pellet 10*i* through its axial hole 16*i*.

When the external power source sends the charge to the high power igniter 62*i*, the charge goes through the cable head assembly and into the pellet igniting device 76*i*. Due to the characteristics of the cartridge heater, the pellet igniting device 76*i* heats up to a high temperature and subsequently heats the body of the combustible pellet 10*i* surrounding it. Once it reaches a certain temperature, the combustible pellet 10*i* will spontaneously ignite and create the flow of heated gas to be directed towards the cutting apparatus via the nozzle sub 68*i*, having the orifice 72*i* through its central axis 74*i*, as discussed above. In certain instances, when an application calls for a stronger flow of heated gas to be directed towards the cutting apparatus, the high power igniter 62*i* may be constructed to allow additional combustible pellets inserted into the high wattage heater 70*i*. It should be understood that in this embodiment, the combustible pellet 10*i* must have the axial hole 16*i* through the central axis 74*i*, other embodiments may not need this limitation to function properly.

Figure 20:
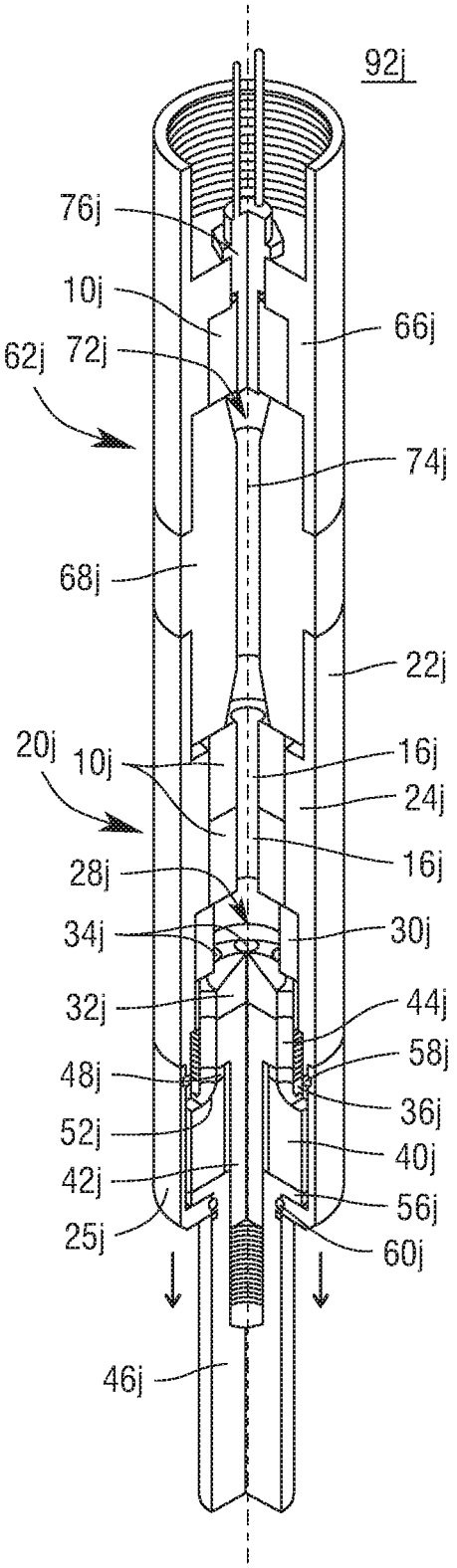
FIG. 20 shows a perspective cut-out view of an embodiment of the system for radially projecting a flow of heated gas.
Figure 21:
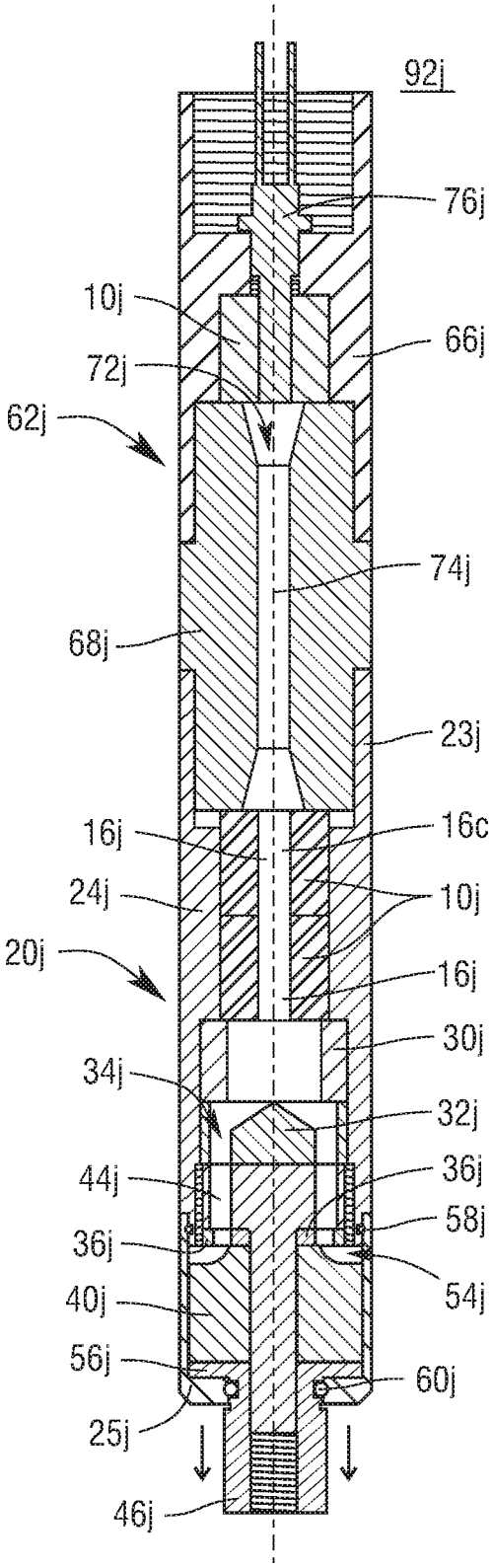
FIG. 21 shows a cross-sectional side view of the system of FIG. 20.

The entire cutting system 92*j* is shown in FIGS. 20 and 21. As disclosed, the embodiment of the high power igniter 62*j* comprises the pellet igniting device 76*j*, which is a cartridge heater releasably secured to the containment sub 66*j* and directly affixed to the axial hole 16*j* of the combustible pellet 10*j*. However, it should be understood that the cutting system 92*j* may incorporate any embodiment of the high power igniter 62*j* disclosed in this patent application and obvious variations thereof. The embodiment of the cutting apparatus 20*j* is the embodiment that does not comprise the chamfer on the diverter 40*j* or the constrictor portion extending from the retainer 36*j*. Again, it should be understood that any embodiment of the cutting apparatus 20*j* disclosed herein, or obvious variations thereof, may be incorporated into the cutting system 92*j*. As stated above, it should also be understood that the cutting system 92*j* is free from any loose powdered forms of combustible material, when the combustible pellets are inserted into the apparatus housing 22*j* and/or igniter housing.

As mentioned above, another limitation associated with prior art cutting systems is that both the cutting apparatus and high power igniter must be fully assembled and ready for activation prior to being transported to the job site, in order to pass government regulations concerning the transport of goods as non-explosive UN1325 sec 4.1 flammable solid classification. During their manufacture, these combustible pellets and loose powder forms of combustible material are packed into cutting apparatuses and only the loose powder forms of combustible material are packed into the high power igniters of the cutting systems and then each were completely sealed off. Sealing these prior art pellets and loose powder is required to receive the UN1325 sec 4.1 flammable solid classification. No loose powdered forms of combustible material are allowed to escape into the surrounding environment during transportation that could cause an unintentional contamination, toxicity, explosion, and/or fire. Cutting apparatuses cannot also be shipped as UN1325 sec 4.1 flammable solid materials over the public highways containing only combustible pellets without the addition of loose combustible powder. All this greatly restricts prior art cutting apparatuses if they hope to be classified as a non-explosive material.

When attempting to implement these prior art igniters without implementing loose powdered forms of combustible material, ineffective ignition of the combustible pellets typically occurs. In certain instances, these prior art cutting apparatuses and igniters are also prone to misfire or not produce flows of heated gas that could cut through a conduit. This further limits these prior art igniters to require loose powder in the axial holes of the pellets while contained in the cutting apparatus. In essence, the aid of the loose powdered forms of combustible material is needed in these prior art devices as an essential catalyst needed to activate the pellets or they are unable to function with any certainty. Certain regulations also typically require the combustible pellets to be constructed to create a flow of heated gas that would only project approximately three feet or less from the prior art cutting systems. Such government regulations include, but are not limited to, the hazard classification of UN1325 sec 4.1 flammable solid.

At the job site, the combustible pellets 10*j* may be inserted into the high power igniter 62*j* and cutting apparatus 20*j*. Separately packaging the combustible pellets 10*j* from the rest of the cutting system 92*j* allows the combustible pellets 10*j* to be placed by themselves during transportation, either in a separate carrier from the cutting system 92*j* or in a separate location in the same carrier transporting the cutting system 92*j*, which greatly improves safety during transportation. This also allows either the combustible pellets 10*j* or the cutting system 92*j* to be stored at the job site, while the other is being transported over from another separate location. It should be noted that the combustible pellets 10*j* and the cutting system 92*j* can also be in close proximity with an insubstantial risk of mishap.

Because the combustible pellets can be loaded into the cutting system 92*j* at the job site, both the high power igniter 62*j* and cutting apparatus 20*j* are typically granted non-hazardous classifications. Being packaged separately, the combustible pellets 10*j* used in the cutting system 92*j* are typically granted a UN1325 sec 4.1 flammable solid classification by the U.S. Department of Transportation. This classification should not require that the cutting system 92*j* have an official license or permit. The combustible pellets 10*j* may therefore be packaged separately from the cutting system 92*j*. The combustible pellets 10*j* typically weigh over 20 grams and, when assembled into the high power igniter 62*j*, as mentioned above, are able to shoot a flow of heated gas from the nozzle sub 68*j* out to a distance of over 15 feet. In order to qualify for the UN1325 flammable solid classification, as mentioned above, preloaded non-explosive igniters of the prior art can only carry enough combustible material to shoot a flow of heated gas out to a distance of approximately three feet. Thus, the prior art factory loaded flammable solid igniters are limited in both size and power by government regulation, whereas the embodiments disclosed herein do not have these limitations.

The steps needed to safely transport and use the high power igniter 62*j* are as follows—convey the combustible pellets 10*j* to the job site where the conduit is to be cut, convey the high power igniter 62*j* separate from the combustible pellets 10*j* to the same job site (within the same transporter or within a different transporter). At the job site, test an external power source (not shown) for a live current running through the external power source via a cable head assembly (not shown). If there is no live current, connect a firing head sub (not shown) to the cable head assembly, connect a blast sleeve sub (not shown) to the firing head sub, connect the containment sub 66*j* with the cartridge heater of the high power igniter 62*j* to the blast sleeve sub. Connect wires from the high power igniter 62*j* to the blast sleeve sub when there is no live current running through the external power source, releasably join the high power igniter 62*j* to the cutting apparatus 20*j* to create the cutting system 92*j*. Once the cutting system 92*j* has been properly assembled, load the combustible pellets 10*j* into the containment sub 66*j* of the high power igniter 62*j* (and anywhere else needed in the cutting system), insert the cutting system 92*j* into the conduit to be cut, accurately position the cutting system 92*j* at the location within the conduit to be cut, and then activate the cutting system 92*j* through the external power source. If there is a live current in the external power source, the cartridge heater would typically indicate there was a dangerous condition that needs to be remedied before the combustible pellets 10*j* should be loaded into the high power igniter 62*j*.

Similarly, the steps needed to safely transport and use the cutting apparatus 20*j* are as follows—convey the combustible pellets 10*j* to the job site where the conduit is to be cut, convey the cutting apparatus 20*j* in a separate location from the combustible pellets 10*j* (within the same transporter or within a different transporter) to the same job site, have a conduit cutting specialist determine the characteristics of the conduit to be cut, assemble the cutting apparatus 20*j* by inserting the appropriate number of combustible pellets 10*j* into the cutting apparatus 20*j* at the job site based on those conduit characteristics, and releasably join the cutting apparatus 20*j* to the high power igniter 62*j* to create the assembled cutting system 92*j*. Once the cutting system 92*j* has been properly assembled, the cutting apparatus 20*j* can be accurately positioned down into the conduit at the appropriate location to be cut. The cutting apparatus 20*j* is then activated by sending a charge to the high power igniter 62*j* through the external power source.

Inserting the appropriate number of combustible pellets 10*j* into the cutting apparatus 20*j* at the job site may also be based on the characteristics of the cutting apparatus 20*j*. A certain smaller-sized cutting apparatus 20*j* may only be able to contain a single combustible pellet 10*j*, which itself could potentially be designed specifically for the characteristics of this cutting apparatus 20*j*. Whereas, a more-powerful, and potentially larger-sized, cutting apparatus 20*j* could contain multiple combustible pellets 10*j*, in certain instances, more than two combustible pellets 10*j* can be inserted into the cutting apparatus 20*j*. As explained above, the more combustible pellets 10*j* within the cutting apparatus 20*j* will increase the surface area of combustible material, which ultimately increases the Kn within the cutting apparatus 20*j*.

Figure 22:
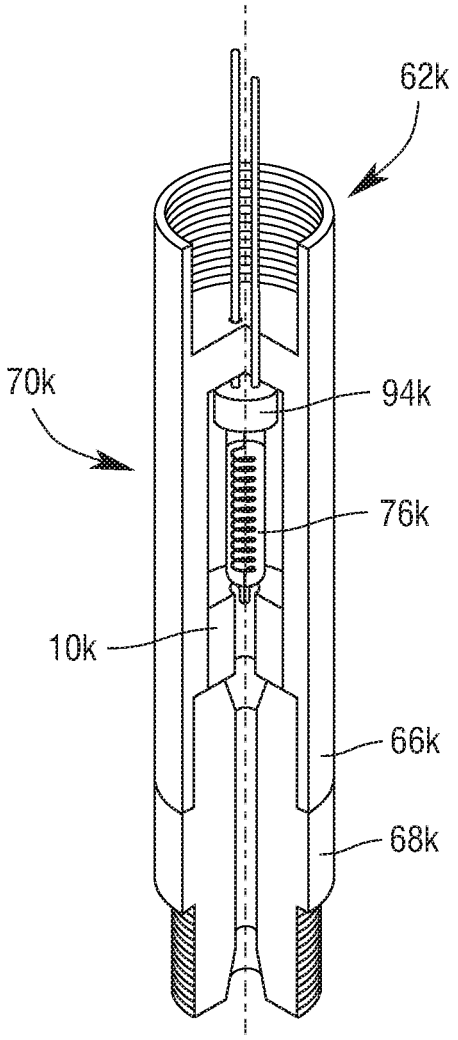
FIG. 22 shows a perspective cut-out view of an embodiment of the high power igniter that connects to the cutting apparatus.

Another embodiment of the high power igniter 62*k* is shown in FIG. 22. In this embodiment, the high wattage heater 70*k* comprises a combustible pellet 10*k*, discussed above, and a pellet igniting device 76*k*, which is a halogen lamp. The halogen lamp is typically a 130 volt/250 watt halogen lamp (JCD 130 volt/250 watt GY6.35) that may be manufactured by Hikari Corp or another similar manufacturer. The halogen lamp may also be known by one having ordinary skill in the art as a tungsten-halogen lamp, quartz-halogen lamp or quartz-iodine lamp. Essentially, the pellet igniting device 76*k* is an incandescent lamp that has a certain added amount of a halogen such as, but not limited to, iodine or bromine. The combination of the halogen gas and the tungsten filament produces a halogen cycle chemical reaction, which redeposits evaporated tungsten back onto the filament. Because of this, the pellet igniting device 76*k* can be operated at a higher temperature than pellet igniting devices 76*k* embodied as standard gas-filled lamps of similar powers and operating lives. This embodiment of pellet igniting device 76*k* also gets hotter than other varieties of incandescent lamps because the heat is concentrated on a smaller envelope surface, and because the surface is closer to the filament. This high temperature is essential to the operation of the high wattage heater 70*k*. Because these pellet igniting devices 76*k* operate at very high temperatures, they are able to cause ignition of the combustible pellets 10*k*.

When this embodiment of the high power igniter 62*k* is constructed for use, the combustible pellet 10*g* and pellet igniting device 76*k* are encapsulated in the containment sub 66*k*. The pellet igniting device 76*k* releasably connects with a power socket 94*k* that allows electricity from the power source to be connected to and flow through the pellet igniting device 76*k*. The power socket 94*k* is joined to the containment sub 66*k*. Typically, adhesives are used to join the power socket 94*k* to the containment sub 66*k*, but other joining mechanisms may be used, such as, but not limited to, staples, tacks, nails, welding, so long as the joining mechanisms used produce a pressure tight seal. The pellet igniting device 76*k* is situated in close proximity with the combustible pellet 10*k*, while both are encapsulated within the containment sub 66*k*. When electrified over a long enough duration of time, the pellet igniting device 76*k* will raise the surrounding temperature to one that heats the body of the combustible pellet 10*k*. Once a certain temperature is reached, the combustible pellet 10*k* will spontaneously ignite and create the flow of heated gas to be directed towards the cutting apparatus via the nozzle sub 68*h*, having the orifice 72*h* through its central axis 74*h*, as discussed above.

Figure 23:
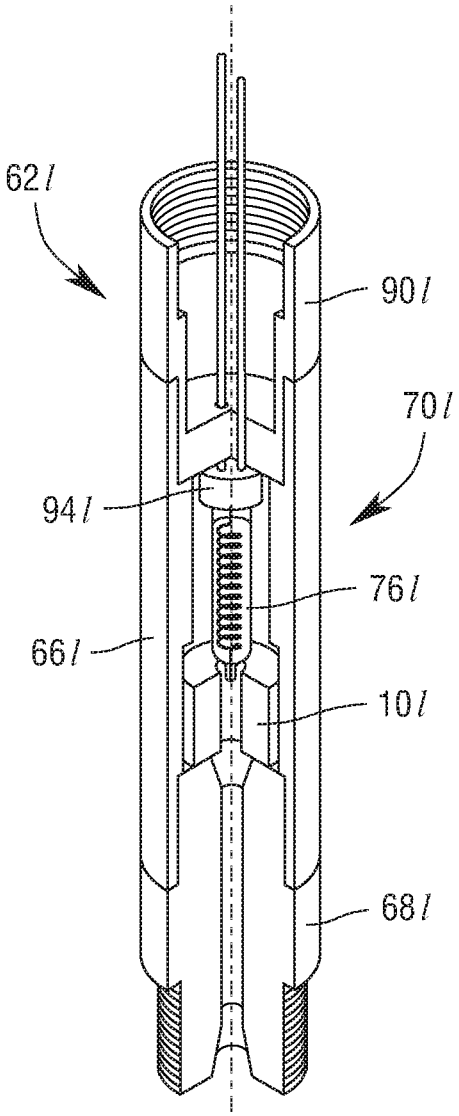
FIG. 23 shows a perspective cut-out view of an embodiment of the high power igniter that connects to the cutting apparatus.

Another embodiment of the high power igniter 62*l* is shown in FIG. 23. In this embodiment, the high wattage heater 70*l* comprises a combustible pellet 10*l*, a threaded segment 90*l*, and a pellet igniting device 76*l*, which is a halogen lamp, each discussed above. When the high power igniter 62*l* is constructed for use, the combustible pellet 10*l* and pellet igniting device 76*l* are encapsulated in the containment sub 66*l*. The threaded segment 90*l* is threadably secured to the containment sub 66*l*. The containment sub 66*l* is threadably secured to the nozzle sub 68*l*. The pellet igniting device 76*l* releasably connects with a power socket 94*l*, discussed above, joined to the threaded segment 90*l*. Typically, adhesives are used to join the power socket 94*l* to the threaded segment 90*l*, but other joining mechanisms may be used, such as, but not limited to, staples, tacks, nails, or welding. The pellet igniting device 76*l* is situated in close proximity with the combustible pellet 10*l*, while both are encapsulated within the containment sub 66*l*. When electrified over a long enough duration of time, the pellet igniting device 76*l* will raise the surrounding temperature to one that heats the body of the combustible pellet 10*l*. Once a certain temperature is reached, the combustible pellet 10*l* will spontaneously ignite and create the flow of heated gas to be directed towards the cutting apparatus, as discussed above.

Figure 24:
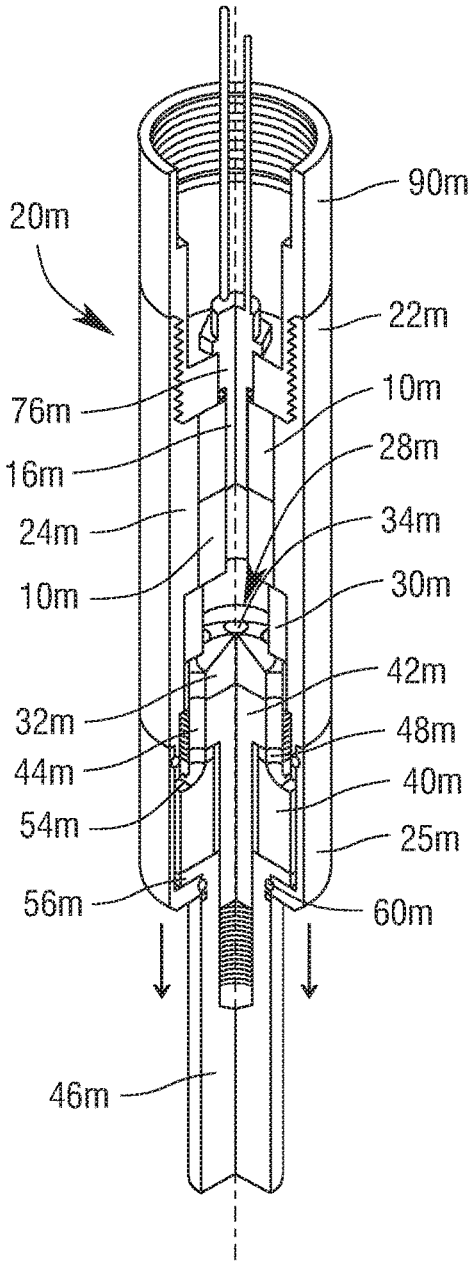
FIG. 24 shows a perspective cut-out view of an embodiment of the cutting apparatus for radially projecting a flow of heated gas.
Figure 25:
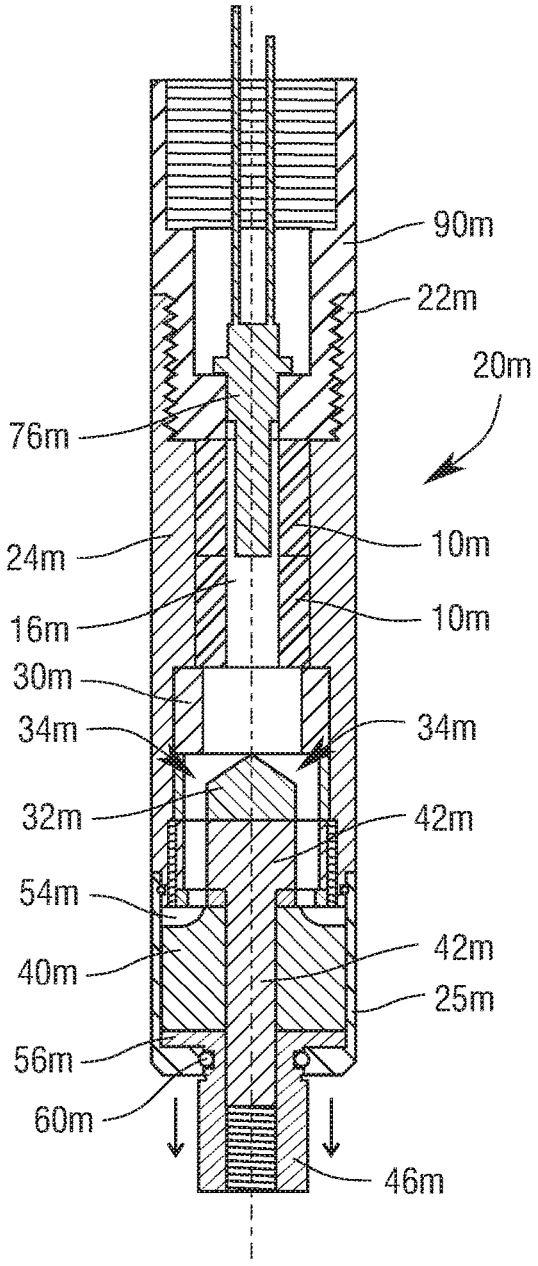
FIG. 25 shows a cross-sectional side view of the cutting apparatus of FIG. 24.

As shown in FIGS. 24 and 25, the cutting apparatus 20*m* can be ignited without the assistance of the high power igniter. To ignite the cutting apparatus 20*m* in this fashion, a threaded segment 90*m* is threadably secured directly to the cutting apparatus 20*m*. When the cutting apparatus 20*m* is constructed for use, a pellet igniting device 76*m*, which in this embodiment is a cartridge heater, is both releasably secured to the threaded segment 90*m* and affixed to the combustible pellet 10*m* through its axial hole 16*m*.

When the external power source sends the charge, the pellet igniting device 76*m* heats up and subsequently heats the body of the combustible pellet 10*m* surrounding it. Once a certain temperature has been reached, the combustible pellet 10*m* will spontaneously ignite and create the flow of heated gas in the cutting apparatus 20*m* that is to pass through the circumferential diverter gap 54*m*, as discussed above. It should be understood that in this embodiment, the combustible pellet 10*m* must have the axial hole 16*m* through the central axis 18*m*, other similar embodiments may not need this limitation to function properly. It should be understood that, to the extent practical, each of the methods discussed herein are not required to be performed in the order that they are disclosed.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A combustible pellet for creating heated gas:

wherein said combustible pellet is for use in a non-explosive conduit cutting apparatus or a non-explosive high power igniter for a conduit cutting apparatus or both; and said combustible pellet comprising:

said combustible pellet is compacted to be resistant to mechanical damage;

said combustible pellet is resistant to unintentional ignition; and said combustible pellet is ignitable without a loose powdered form of combustible material when said combustible pellet is in the non-explosive conduit cutting apparatus or the non-explosive high power igniter for a conduit cutting apparatus.

2. The combustible pellet of claim 1 wherein said combustible pellet is compacted to between 90 percent and 99 percent of its theoretical density.

3. The combustible pellet of claim 1 wherein said combustible pellet is capable of being transported separate from the non-explosive conduit cutting apparatus or the non-explosive high power igniter for a conduit cutting apparatus or both.

4. The combustible pellet of claim 1 wherein said combustible pellet is capable of being stored separate from the non-explosive conduit cutting apparatus or the non-explosive high power igniter for a conduit cutting apparatus or both.

5. The combustible pellet of claim 1 wherein said combustible pellet is made from thermite, oxidizers, carbon-based fuels, Polytetrafluoroethylene, Fluoropolymer elastomer, other polymers, or some combination thereof.

6. The combustible pellet of claim 1 wherein said combustible pellet comprising a circular cross-section and tubular length.

7. The combustible pellet of claim 1 wherein said combustible pellet comprising an axial hole.

* * * * *